US011819861B2

(12) United States Patent
Hedrick

(10) Patent No.: US 11,819,861 B2
(45) Date of Patent: Nov. 21, 2023

(54) UNIFLOW CYCLONE SEPARATOR WITH STABLE VORTEX AND TANGENTIAL HEAVY PHASE EXTRACTION

(71) Applicant: Brian W. Hedrick, Oregon, IL (US)

(72) Inventor: Brian W. Hedrick, Oregon, IL (US)

( * ) Notice: Subject to any disclaimer, the term of this patent is extended or adjusted under 35 U.S.C. 154(b) by 0 days.

(21) Appl. No.: 18/188,130

(22) Filed: Mar. 22, 2023

(65) Prior Publication Data

US 2023/0302467 A1 Sep. 28, 2023

Related U.S. Application Data

(60) Provisional application No. 63/269,721, filed on Mar. 22, 2022.

(51) Int. Cl.

| | |
|---|---|
| ***B04C 3/06*** | (2006.01) |
| ***B04C 3/04*** | (2006.01) |
| *B04C 3/00* | (2006.01) |

(52) U.S. Cl.
CPC ..... *B04C 3/06* (2013.01); *B04C 3/04* (2013.01); *B04C 2003/006* (2013.01)

(58) Field of Classification Search
CPC ..... B04C 3/06; B04C 3/04; B04C 2003/006
See application file for complete search history.

(56) References Cited

U.S. PATENT DOCUMENTS 1,735,298 A * 11/1929 Pfeffer ..... B04C 3/04 55/343
3,895,930 A 7/1975 Campolong
3,917,568 A 11/1975 Klein et al.
4,289,611 A * 9/1981 Brockmann ..... B04C 3/06 209/710
4,569,687 A * 2/1986 Feng ..... B04C 5/00 55/DIG. 14
5,034,099 A 7/1991 Nilsson
5,462,585 A 10/1995 Niskanen et al.
5,690,709 A * 11/1997 Barnes ..... B04C 3/04 55/318
5,861,052 A 1/1999 Meinander
6,478,962 B1 * 11/2002 Brockhoff ..... A61M 1/3627 96/155
7,066,987 B2 6/2006 Stanbridge
7,799,106 B2 * 9/2010 Rother ..... B01D 50/20 55/348

(Continued)

FOREIGN PATENT DOCUMENTS

| | | | |
|---|---|---|---|
| AU | 2009100485 | A4 | 7/2009 |
| EP | 2082808 | A2 | 7/2009 |
| KR | 20120001032 | A | 1/2012 |

OTHER PUBLICATIONS

David Cannon, Centrifugal Separators: Working Principle, Benefits, and Applications Discussed, Oct. 16, 2019.

*Primary Examiner* — Dung H Bui
(74) *Attorney, Agent, or Firm* — Bishop, Diehl & Lee, Ltd.

(57) ABSTRACT

A uniflow cyclone that has multiple inlets, normally achieved via a vane, a barrel length, then a solids collection channel of larger diameter but concentric with the barrel and a tangential solids outlet to either a plenum or a dust hopper. The gas flows past the enlarged channel and continues through additional barrel length to an outlet zone. The cyclone would normally have a concentric center pipe the extends from the vane to the gas outlet of the cyclone.

8 Claims, 21 Drawing Sheets
(8 of 21 Drawing Sheet(s) Filed in Color)

(56) References Cited

U.S. PATENT DOCUMENTS

| | | | | |
|---|---|---|---|---|
| 7,857,879 | B2 | 12/2010 | Egger | |
| 8,202,356 | B2 | 6/2012 | Meinander et al. | |
| 8,322,434 | B2 | 12/2012 | Fielding et al. | |
| 10,036,319 | B2 * | 7/2018 | Murray | B01D 45/16 |
| 10,137,462 | B2 | 11/2018 | Goulds et al. | |
| 2008/0006250 | A1 * | 1/2008 | Bula | F02C 7/052<br>123/184.21 |
| 2010/0275561 | A1 * | 11/2010 | Lundquist | B04C 3/06<br>524/570 |
| 2012/0103423 | A1 * | 5/2012 | Schook | B04C 3/00<br>137/1 |
| 2015/0328571 | A1 * | 11/2015 | Son | B04C 3/06<br>55/418 |
| 2020/0353394 | A1 * | 11/2020 | Chen | B01D 45/14 |
| 2021/0291095 | A1 * | 9/2021 | Peterson | E03B 3/28 |

* cited by examiner (Third Stage Separator from Patent US 6,673,133 B2)

(10 to 100 micron diameter particles)

(0 to 10 micron diameter particles)

TSS Cyclone

Cut-away barrel

Detail of Ejection Port

UNIFLOW CYCLONE SEPARATOR WITH STABLE VORTEX AND TANGENTIAL HEAVY PHASE EXTRACTION

RELATED APPLICATION

The current disclosure claims the filing priority of U.S. Provisional Application No. 63/269,721 titled "Uniflow Cyclone Separator With Stable Vortex And Tangential Heavy Phase Extraction," filed on Mar. 22, 2022. The '721 Provisional Application is hereby incorporated in its entirety by reference.

TECHNICAL FIELD OF THE INVENTION

The present invention relates to the field of uniflow cyclone separators. More specifically, the invention relates to stackable uniflow cyclone separators with a continuous, uninterrupted, and stable vortex through each stage.

BACKGROUND OF THE INVENTION

A cyclone separator is a device for separating solid particles from contaminated gas streams and has long been used in industrial applications such as power generations, gas turbines, chemical processes, and so forth.

There are well-established theories on cyclone performance. Stoke's Law describes the terminal velocity of a particle settling in a fluid in Equation 1 below:

$$V_t = gD_p^2(\rho_P - \rho_G)/(18\mu_G) \quad \text{(Eq 1)}$$

In this equation g is gravitation, $D_P$ is particle diameter, $\rho_P$ is particle density, $\rho_G$ is gas density, and $\mu_G$ is gas viscosity. Once the cyclone design has been set, the number of revolutions the gas makes in the cyclone barrel is set as is the distance traveled. The inlet velocity dictates how fast the gas and particles flow thru the cyclone and the gravitational forces are determined.

$$(D_P)_{th} = (9\mu_G w/\pi N_s v_i(\rho_P - \rho_G)^{0.5} \quad \text{(Eq. 2)}$$

Using Equation 2 above, a particle with a given diameter will settle a distance w when the gas velocity, number of revolutions in the barrel, the gas viscosity, the gas density, and the particle density are all known. Equation 2 can be rearranged to find the distance w that a particle of a given size will settle. Further, if the distance w is divided by the annular distance between the outlet tube and the cyclone barrel, the collection efficiency for any given particle size can be computed by Equation 3 below:

$$Eff_{th} = (D_P^2 \pi N_s(\rho_P - \rho_G)/(9\mu_G w_c))100\% \quad \text{(Eq. 3)}$$

Equation 3 does not take into account the interactions that occur between particles. Large particles settle faster than smaller particles. Large particles will collide with smaller particles on their way to the cyclone wall, so when the loading of larger particles in the gas entering the cyclone is increased, the probability of larger particle encountering a smaller particle is also increased. Indeed, it has been observed that increasing the dust loading to a cyclone will tend to increase the collection efficiency of the smaller particles.

Equation 3 likewise does not consider the migration of gas from the primary vortex to the inner vortex. The rate at which this migration takes place depends on the individual cyclone design. Even then the calculation has assumptions, such as equal migration at each elevation. These phenomena will reduce the efficiency of particles below a certain size.

Another shortcoming of Equation 3 is that it does not take into account gas and solids by-passing to the outlet tube at the cyclone inlet.

FIG. 1 uses Equation 3 to predict grade-efficiency curves for the first stage of a voluted cyclone used in a fluidized bed catalytic cracking (FCC) unit regenerator with various barrel lengths. The effect of gas by-passing would be to shift the curves slightly to the right and to change the shape of the curve at the top. That is, if by-passing occurs, then some amount of all sizes would not be collected. Indeed, FIG. 17 of Stairmand's (3) classic paper of 1951 shows this deviation (see, C. J. Stairmand, *The design and performance of cyclone separators*, Trans. Inst. Chem. Eng. 29 (1951), pp. 356-383).

This simple theoretical approach is useful because it establishes a baseline to which experimental work may be compared. The closer a cyclone develop program gets to this performance, the better.

One way to improve the predictions of Equation 3 is to use modern mathematical modeling tools, such as computational fluid dynamics (CFD). CFD does a very good job of predicting gas flow patterns in cyclones of various designs.

As good as CFD work is, it still struggles to predict the interaction between particles in the vortex. That is, accurately predict the effects of particle loading on the grade efficiency curve.

STATE OF THE ART

The current use of cyclone separators is very common in the petroleum refining industry mainly for the retention of catalyst fines in FCC Units. For simplicity, the FCC Unit is used as an example of how cyclone separators and the present invention can be used. More specifically, the FCC Unit regenerator and third-stage separator devices will be used.

There are many different types of cyclones but for the present disclosure only two will be discussed: (1) the reverse flow, commonly called a Stairmand cyclone, and (2) the uniflow cyclone.

Reverse Flow

The regenerator uses air to burn coke from the catalyst in the regenerator to restore activity. The flue gas from this activity exits the top of the regenerator. However, any entrained catalyst must first be removed from the flue gas and returned to the process. This is achieved using two stages of cyclones located above the normal fluidized bed of the regenerator. Flue gas enters the first stage which is designed to remove about 90% of the entrained fines. The fines exit the bottom of the cyclone through a dust hopper which empties into a dip leg. The dip leg extends from the bottom of the dust hopper to a fluidized bed below. The catalyst in the dip leg accumulates until a level is reached at which the head at the bottom of the dip leg is sufficient to overcome the cyclone head loss, then it exits the dip leg through either a trickle valve or flapper valve into the bed below.

The flue gas exits the first stage cyclone and is ducted directly into a second stage where the same process is repeated but at a higher velocity and, therefore, higher g-forces. The second stage removes finer particles from the flue gas but many 20-micron minus particles remain. The cyclone pair is generally designed to reduce the catalyst loading down to approximately 400 mg of catalyst/$Nm^3$ of flue gas, depending on the FCC Unit's specifications.

The arrangement of cyclone separators in a fluidized bed, as shown in FIG. 1 of U.S. Pat. No. 6,110,356 (Hedrick et al.), depicts a bubbling bed regenerator and shows how the cyclones, dust hoppers and dip legs work (other types of regenerators exist but they have similar catalyst separation and return systems). It does not show multiple cyclone-sets, as most units have multiple sets. The '356 patent is hereby incorporated by reference.

The remaining flue gas fines are detrimental to health and downstream power recovery equipment. To further reduce the fines, especially for power recovery equipment but sometimes for final flue gas clean-up, a third-stage separator can be employed.

However, there are problems and limitations to consider. FIG. 2 shows a Computational Fluid Dynamics (CFD) simulation of a standard cyclone. This figure shows the gas flow contours, solid lines and is color coded for velocity magnitude. The simulation shows the instability of the vortex in that it is not straight up and down, it wobbles and has velocity irregularities at the wall of the barrel and the cone. The simulation also shows gas by-passing at the outlet tube entry. That is, some of the gas entering the cyclone immediately migrates to the outlet tube.

FIG. 3 is a different representation of the same simulation showing actual velocities. Negative values are into the paper and positive values are out of the paper. This figure more accurately depicts gas by-passing. These results are typical of CFD simulations described in the literature, especially for voluted cyclones.

Gas by-passing and non-uniform vortex profiles contribute to reduced efficiency in this type of cyclone. When gas short cuts from the inlet to the outlet tube drawing solids with it. Instability in the vortex can lead to solids in the collected zone being drawn into the inner vortex and out the outlet tube.

Generally speaking, the capacity of the containment vessel for cyclones in a fluidized bed is limited by the number of cyclones that can be physically fitted into the vessel. When a process unit is originally designed, it is usually for a specific gas superficial velocity in the fluidized bed and for a specific velocity through the cyclone separators. These velocities vary from vendor to vendor. At a later date the unit may be revamped for higher capacity. When this happens, it is very expensive to replace the actual vessel but relatively inexpensive to add more cyclones and to operate the vessel at a higher superficial velocity. Since there is a limit to how many cyclones can actually fit into the vessel, they limit the ultimate capacity of the vessel.

FIG. 4 shows a 42.5 ft diameter vessel with a maximum number of 55-inch diameter cyclones with volutes fitted into it. This may vary depending on the spacing criteria used by a designer.

Uniflow Cyclones

Uniflow cyclones are used in FCCU third-stage separators (TSS) and are generally smaller in size. The cyclones are mounted between two tube sheets. Gas enters from above, flows thru vanes creating a vortex. The fines flow to the wall and, after a predetermined barrel length, the gas accelerates into an outlet tube of smaller diameter then through the second tube sheet. The solids continue down the wall of the main barrel below the outlet tube inlet. At some point above the second tube sheet, the solids exit the barrel through a slot into the space between the two tube sheets and flows to an outlet tube. A full description of this can be found in U.S. Pat. No. 7,316,733 B1, to Hedrick et al. and U.S. Pat. No. 6,673,133, B2, to Sechrist et al. The '733 patent and the '133 patent are hereby incorporated by reference. FIG. 5 was extracted from the '133 patent and shows multiple cyclones mounted in the vessel and the tube sheets. There are three notable problems with this type of cyclones.

First, the gas enters the cyclone at the top (60), passes through the vanes, then proceeds through the cyclone barrel (62). When the gas clears the vane, it expands into the all the space available. At this point, the vortex has a significant reduction in tangential velocity as the gas rushes to the center of the cyclone. This causes solids collected in the vane zone to pull away from the wall.

Second, the gas accelerates in order to enter the outlet tube (70). When this happens, most of the solids remain at the wall and continue down into the lower section of the cyclone, i.e., the cyclone barrel. However, this rapid movement of gas to the outlet tube draws some of the collected particles with it into the outlet tube.

Third, the lower section of the cyclone has its own primary vortex which proceeds to the bottom of the barrel, but there is also a reverse vortex inside the primary vortex that hugs the outlet tube wall. This reverse vortex takes excess gas from the primary vortex back to the outlet tube entrance. It also takes with it some of the collected solids to the outlet tube entrance.

In summary, the two cyclone types in the current state of the art have several shortcomings as listed below.

1. Stairmand-type cyclone problems include:
   a. Gas and particle by-passing;
   b. Primary vortex stability;
   c. Particle migration against the centrifugal field due to gas migration from primary vortex to secondary vortex;
   d. Entrainment of particles at the bottom of the cyclone by the secondary vortex; and
   e. Primary and Secondary cyclone pairs limit the ultimate gas capacity of fluidized bed vessels (see U.S. Pat. No. 10,695,775 B 1).
2. Uniflow Cyclone problems include:
   a. Expansion of the vortex after the inlet vane assembly;
   b. Gas acceleration and vortex compression into the outlet tube at the bottom of the collection section; and
   c. Formation of a primary and secondary vortexes between the barrel and outlet tube assembly below the gas outlet:
      i. Similar to Stairmand cyclones, gas migrates from the primary to secondary vortex drawing particles with it; and
      ii. The secondary vortex rises in the annular space until it overflows into the outlet tube, drawing particles with it.

Features and Aspects of Invention

Specific embodiments of the disclosed invention overcome the shortcomings of prior art devices by including features such as:

1. Reduced footprint of primary and secondary pairs of cyclones by stacking primary and secondary cyclones on top of each other, as additional tangent length of is generally less expensive than changing vessel diameter;
2. Elimination of secondary vortexes;
3. Elimination of gas and particle by-passing;
4. Reduced vortex anomalies and instabilities; and
5. Reduced pressure drop thru cyclone pairs thus enhancing flue gas power recovery efficiencies.

Until the invention of the present application, these and other problems in the prior art went either unnoticed or unsolved by those skilled in the art. The present invention provides a unique uniflow cyclone separator which performs the desired functions with associated devices without sacrificing efficiency.

SUMMARY OF THE INVENTION

There is disclosed herein an improved uniflow cyclone separator which avoids many of the disadvantages of prior devices while affording additional structural and operating advantages.

Generally speaking, the uniflow cyclone separator is used for removing solids from a fluid vortex and comprises a first (or single) stage separator having a barrel, a center pipe, a gas inlet, a vane, a peripheral channel, and a tangential solids ejection port. The barrel includes first and second ends and is comprised of a cylindrical wall having a predetermined height. The center pipe is positioned within the barrel and extends for at least the entire height of the cylindrical wall. The gas inlet injects a fluid (preferably a gas) into the barrel proximate the first end, while the vane is attached to the center pipe proximate the gas inlet and creates a vortex from the injected fluid. The peripheral channel is positioned within the cylindrical wall proximate the second end of the barrel, and the tangential solids ejection port connects the peripheral channel to a dust hopper. In operation, the created vortex remains relatively undisturbed and continues through the barrel past the peripheral channel, and entrained solids within the vortex are removed by entering the dust hopper via the peripheral channel.

In specific embodiments, the uniflow cyclone separator includes a dip leg connected to the dust hopper. Preferably, the dip leg comprises a length to build sufficient head to overcome cyclone pressure drop and discharge solids into a cyclone inlet zone.

In specific embodiments, the uniflow cyclone separator further includes a second stage separator stacked onto the first stage separator. Preferably, the second stage separator is constructed substantially similar to the first stage separator. That is, the second stage separator comprises an extension of the cylindrical wall from the second end to an extended end, an extension of the center pipe to extend the center pipe for at least the entire height of the cylindrical wall and the extension of the cylindrical wall, a second vane attached to the extension of the center pipe above the peripheral channel, the second vane being for maintaining the vortex of the injected fluid, a second peripheral channel positioned within the extension of the cylindrical wall proximate the second end of the barrel, and a second tangential solids ejection port connecting the second peripheral channel to a second dust hopper. Preferably, the created and maintained vortex remains relatively undisturbed and continues through the barrel past the second peripheral channel and entrained solids within the vortex are removed by entering the second dust hopper via the second peripheral channel.

In specific embodiments, the vortex is modified by the second vane with a pitch to change the velocity in the vortex by changing the vortex angle.

In specific embodiments, the uniflow cyclone separator comprises a plurality of cyclone separator stages—i.e., multiple stages—stacked consecutively onto the first stage separator. Each of the plurality of cyclone separator stages comprises an extension of the cylindrical wall from a previous stage wall to an extended end, an extension of the center pipe to extend the center pipe for at least the entire height of the cylindrical wall and the extension of the cylindrical wall, a tertiary vane attached to the extension of the center pipe for maintaining the vortex of the injected fluid, a tertiary peripheral channel positioned within the extension of the cylindrical wall, and a tertiary tangential solids ejection port connected to the tertiary peripheral channel. Preferably, the created and maintained vortex remains relatively undisturbed and continues through the barrel past each tertiary peripheral channel and entrained solids within the vortex are removed by entering the tertiary peripheral channel.

In specific embodiments, the uniflow cyclone separator further comprises a tertiary dust hopper connected to the tertiary peripheral channel of at least one of the plurality of stages in a multiple stage embodiment.

In other specific embodiments, the uniflow cyclone separator further comprises an open area between two tube sheets positioned between consecutive stacked stages of the plurality of stages in a multiple stage design—including the first stage of the separator—wherein entrained solids are ejected from the tertiary solids ejection port into the open area.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings, embodiments thereof, from an inspection of which, when considered in connection with the following description, the subject matter sought to be protected, its construction and operation, and many of its advantages should be readily understood and appreciated.

Note: all data used to prepare appended graphs and simulations is theoretical based on Eq. 3 and Eq. 4 above.

DETAILED DESCRIPTION OF THE INVENTION

While the disclosed uniflow cyclone separator invention is susceptible of embodiments in many different forms, there is shown in the appended drawings and will herein be described in detail at least one preferred embodiment of the invention with the understanding that the present disclosure is to be considered as an exemplification of the principles of the invention and is not intended to limit the broad aspect of the invention to any of the specific embodiments illustrated. Features and alterations described and/or illustrated for one specific embodiment may be applicable to other embodiments, even though not explicitly stated, as would be understood by a person of skill in the art.

Single-Stage Cyclone

Figure 6A:
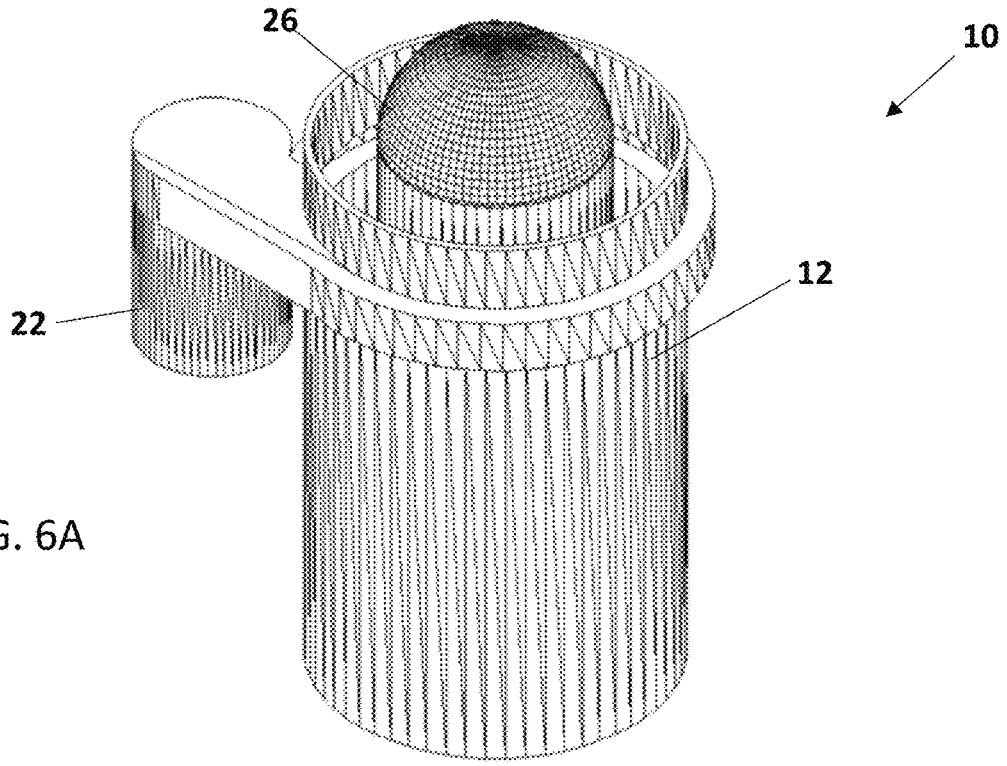
FIG. 6A is a perspective view of an embodiment of the uniflow cyclone separator of the present invention.
Figure 6B:
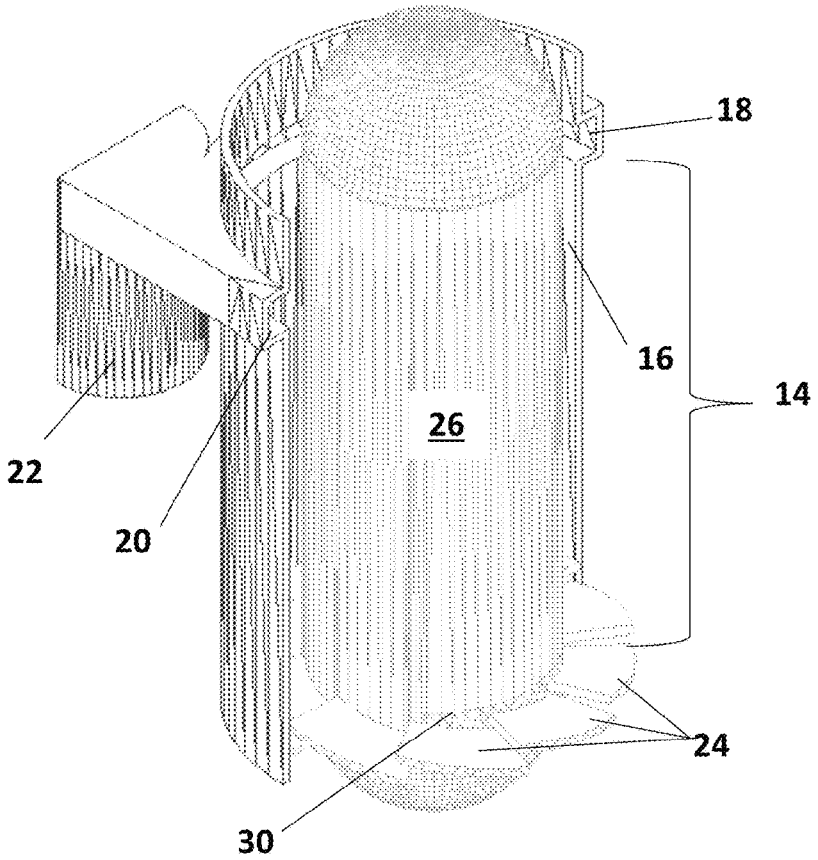
FIG. 6B is a perspective view of the embodiment of FIG. 6A with a section of the cyclone barrel removed.
Figure 6C:
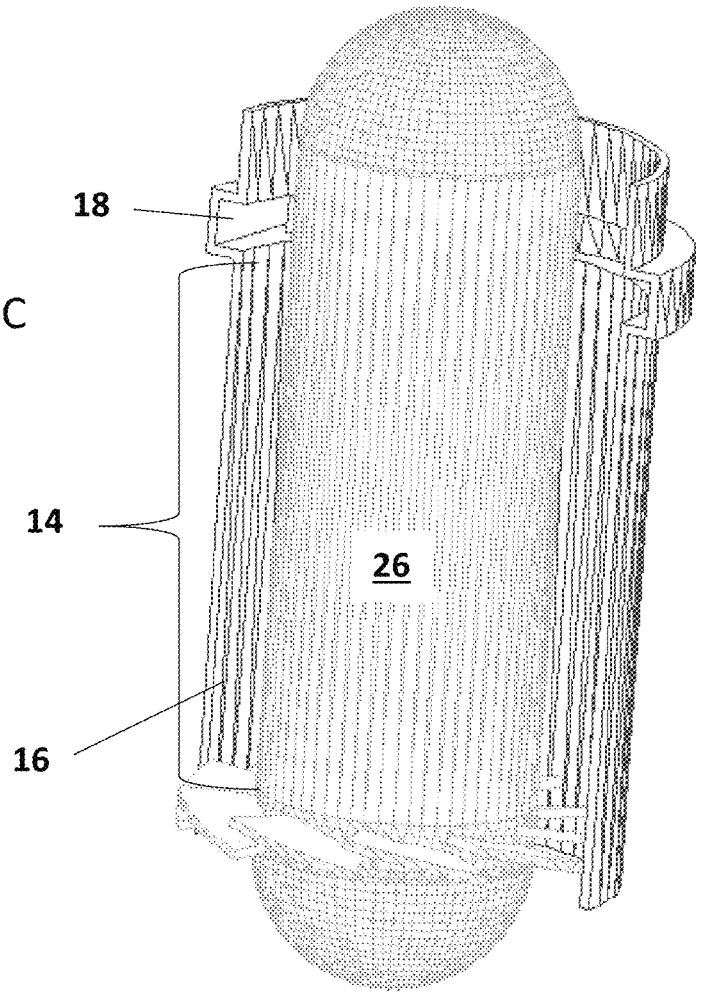
FIG. 6C is a perspective view of the embodiment of FIG. 6B rotated to show the peripheral channel and port leading to the dust hopper.

A simple form of the invention is shown in FIGS. 6A-6C. This cyclone 10 differs from other uniflow cyclones because the vane hub 30 extends thru the entire collection zone 14 of the cyclone 10. The vane 24 initiates a vortex causing entrained dust particles to flow to the cyclone barrel wall 16. Dust particles flow to the wall 16 according to the theoretical principles discussed earlier. When the vortex reaches the top of the barrel 12 the particles are removed from the vortex by an enlarged section of the barrel 12 which creates a channel 18 for the particles to flow in. The gas vortex and any particles which do not reach the wall 16 continue into the top of the cyclone 10 and then out the top. The particles that collect in the channel 18 continue to rotate around the channel perimeter until they reach the solids ejection port 20 that connects the channel 18 to a dust hopper 22. At that point the particles are swept into the dust hopper 22 and eventually into a dip leg (not shown here) and either returned to a bed below in the case a fluidized bed or to an appropriate receptacle.

Figure 7:
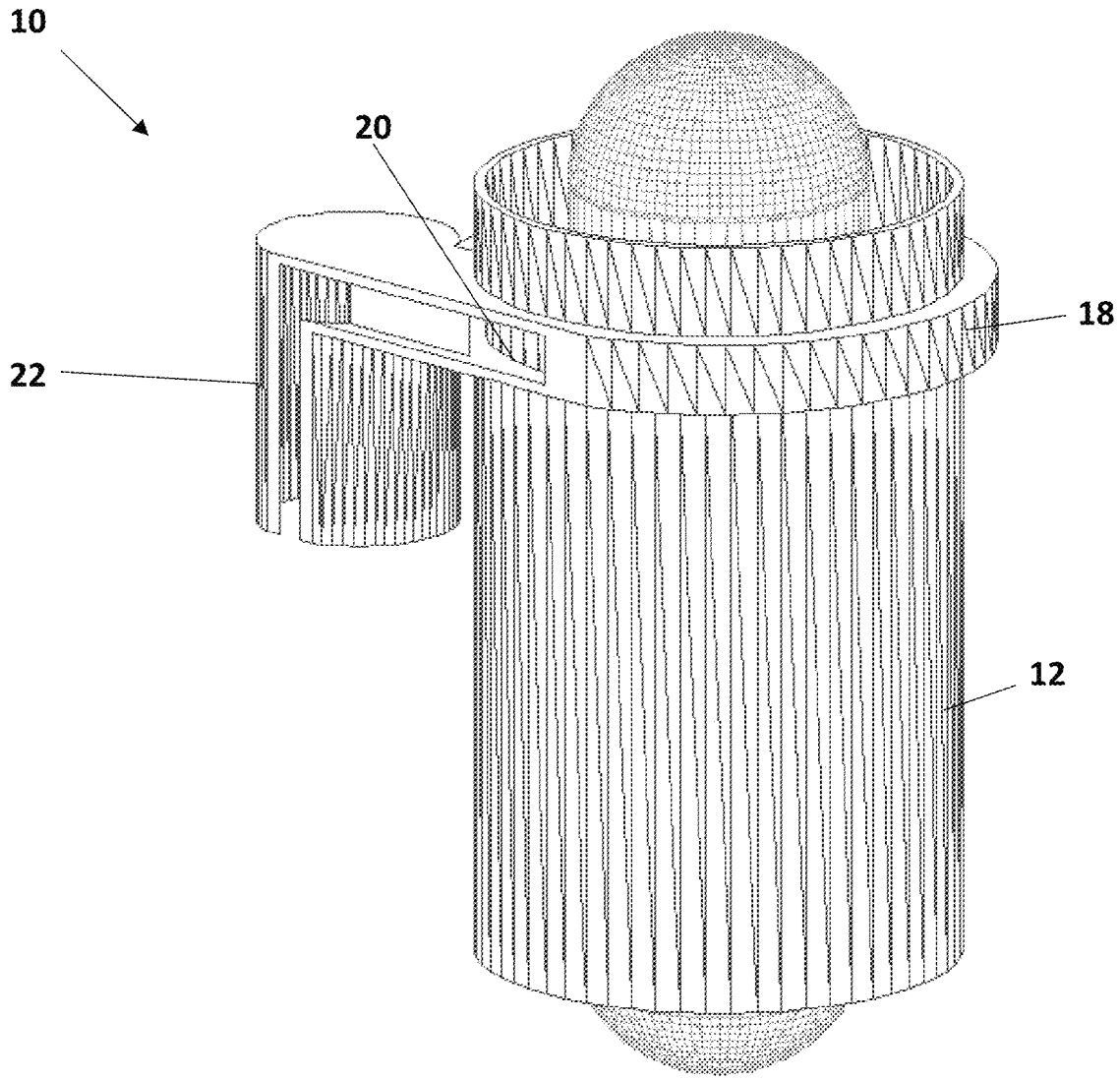
FIG. 7 is a side view of the embodiment of FIG. 6A with a section of an outer surface of the dust hopper and peripheral channel removed.

FIG. 7 shows a cutaway of the outside wall of the channel 18. The wall has been cutaway so the shape of the channel 18 through which the solids exit the cyclone 10 can be shown. This invention is unique because it removes the particles from the vortex instead of removing the vortex from the particles.

Two-Stage/Multi-Stage Cyclone

Figure 8A:
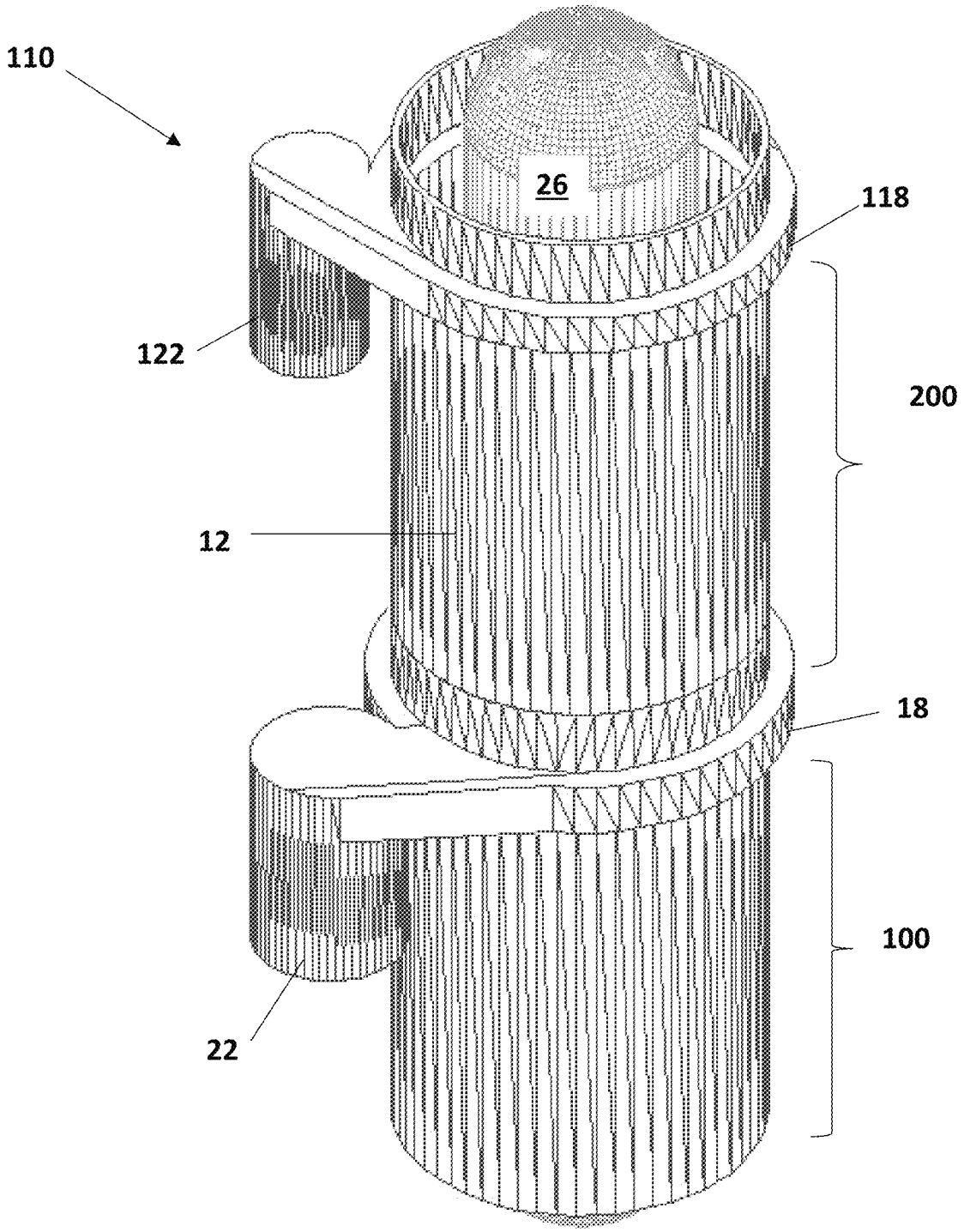
FIG. 8A is perspective view of an embodiment of a two-stage cyclone separator in accordance with the present disclosure.
Figure 8B:
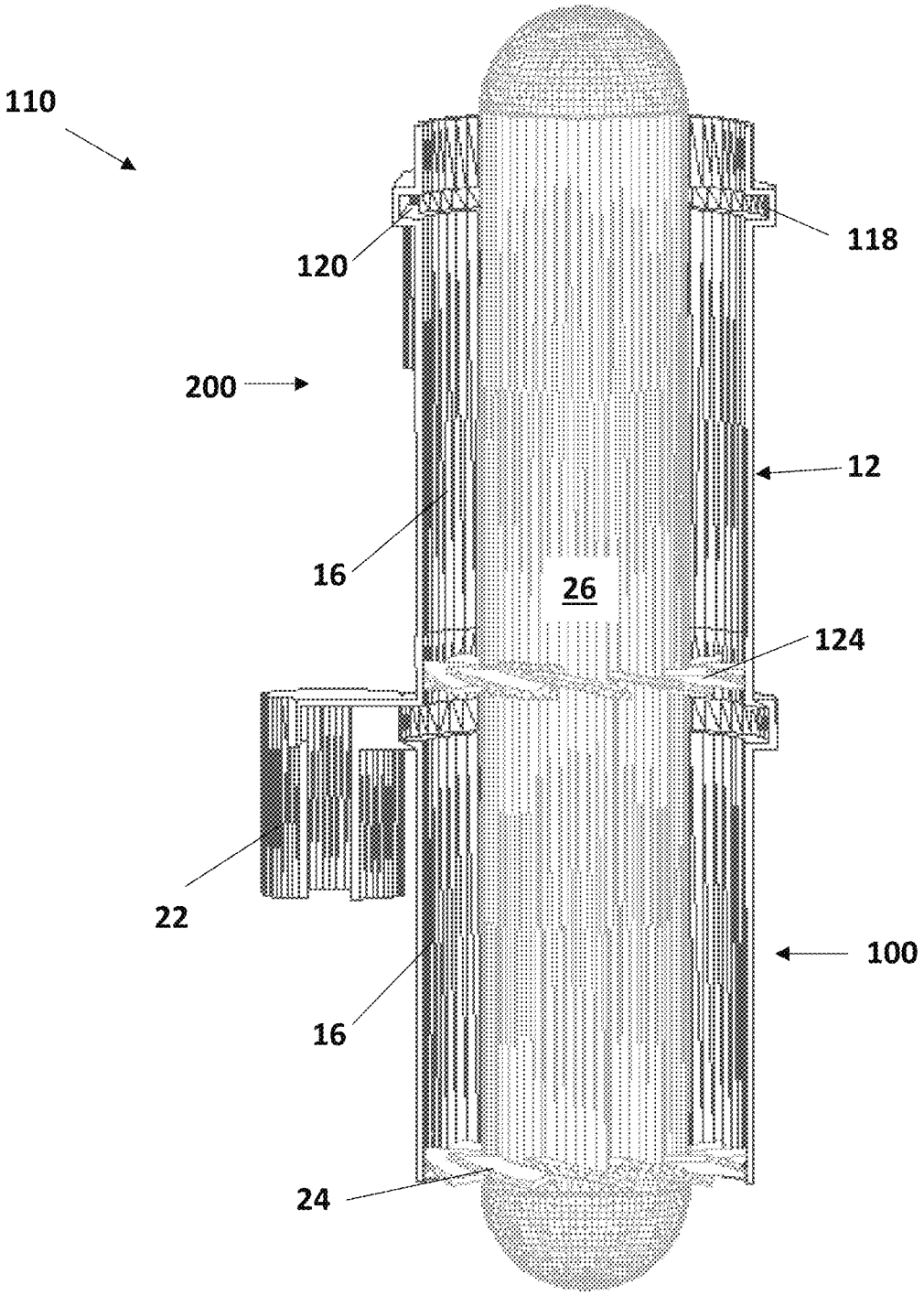
FIG. 8B is a side cross-section of the two-stage cyclone separator of FIG. 8A.

Another unique feature of the disclosed cyclone 10 is that stages can be stacked one upon another without changing vortex direction. FIG. 8 illustrates a two-stage cyclone separator 110 having a first stage 100 and a second stage 200. This cyclone 110 is created by extending the barrel 12 and the center-pipe 26 of the single-stage cyclone 10, then adding a second vane 124 to the center-pipe 26 above the first collection channel 18. A second collection channel 118 is located at the appropriate elevation with a second dust hopper 122 and second solids ejection port 120. The second vane 124 would preferably have a different pitch so as to accelerate the gas to a desired velocity for the second stage 200.

FIG. 8 shows the simplest form of a two-stage version of the cyclone 110. As described, the two-stage cyclone 110, or for that matter multiple stage designs, are created by stacking each consecutive stage onto a previous stage, beginning with the first stage 100. This has several advantages over the classic two cyclone, two-stage or multiple-stage designs.

First, the vortex created in the disclosed design of FIG. 8 is continuous from stage to stage with only a minor modification at the second stage vane 124. This means that if a particle has traveled 75% of the way to the wall in stage one 100, it is still 75% of the way to the wall upon entering the second stage 200. Conversely, in a classic cyclone pair, the particle would be redistributed at the inlet losing any advantage gained in a previous stage.

Second, the disclosed cyclone 110 induces a major direction change and gas acceleration at the inlet 40 to the device and then has a minor modification and small acceleration at the second vane 124. The classic cyclone has a similar major direction change and acceleration at the inlet, with a subtle direction change between the primary and secondary vortices, then a major acceleration into the outlet tube, followed by a major direction change and velocity change entering the second stage. The second stage of the classic cyclone has a further pressure drop as the gas flows from the primary to the secondary vortex, then to the outlet tube before exiting.

Third, in a classic cyclone the gas enters between the top of the cyclone and about halfway down the barrel through an inlet duct. That means gas entering at the top of the cyclone has approximately two revolutions in the barrel while gas entering at the bottom of the inlet duct has only about one revolution. In the disclosed cyclone 10, 110, all of the gas enters the barrel 12 at the same approximate elevation. As a result, all of the gas undergoes the same number of rotations. If the barrels are of equal length (classic vs. present design), then the disclosed uniflow cyclone 10, 110 will have a longer effective barrel length and thus a higher potential efficiency than its classic counterpart. Likewise, a designer could decide to build a shorter cyclone barrel, for example about 75% of conventional barrel length, for an efficiency similar to the longer barreled classic design.

Figure 1:
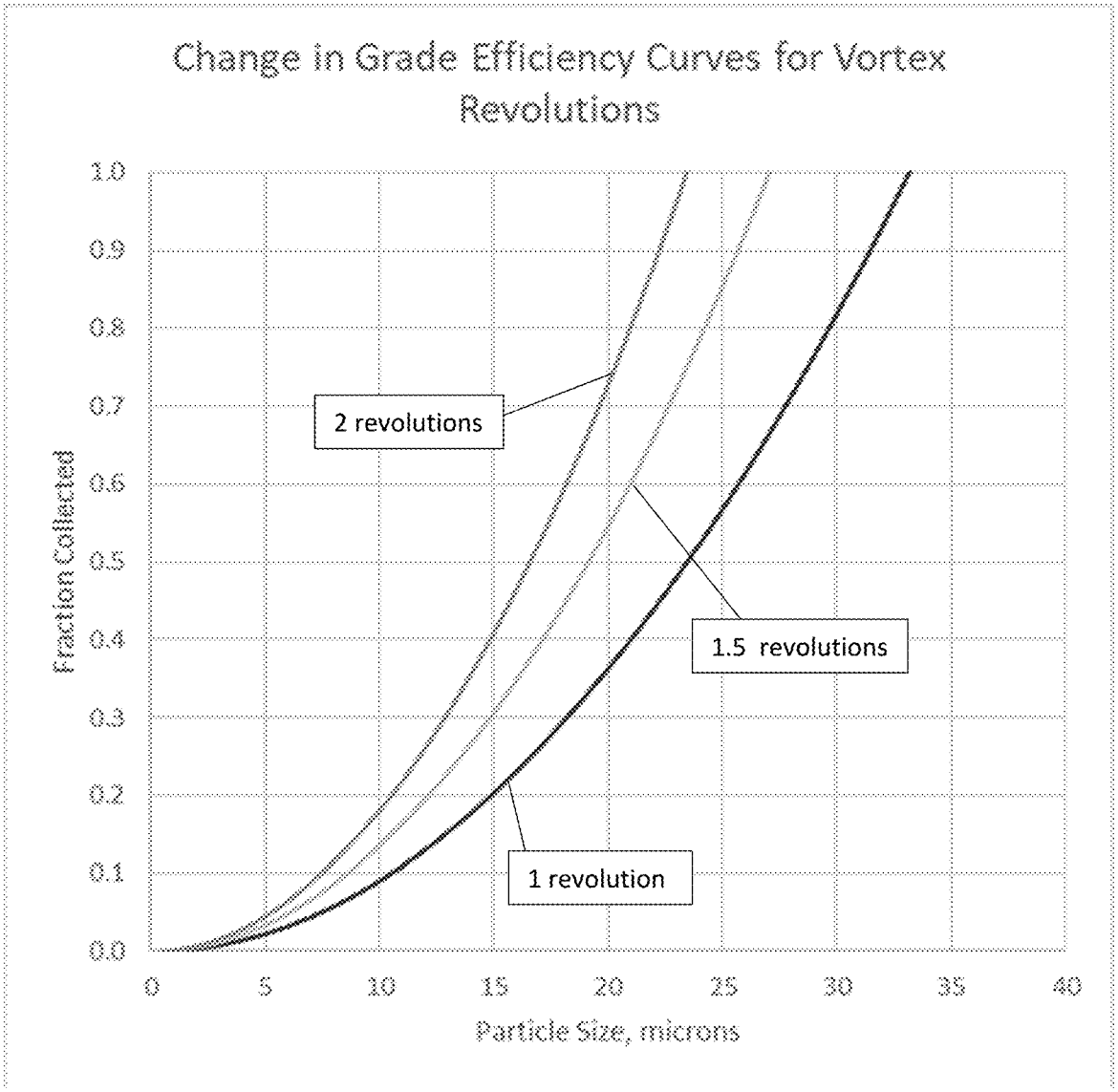
FIG. 1 is a line chart showing typical grade efficiency curves predicted by Equation 3 for a single-stage cyclone operated at typical FCCU conditions based on vortex revolutions (1 rev. vs. 1.5 rev. vs. 2 rev.)
Figure 2:
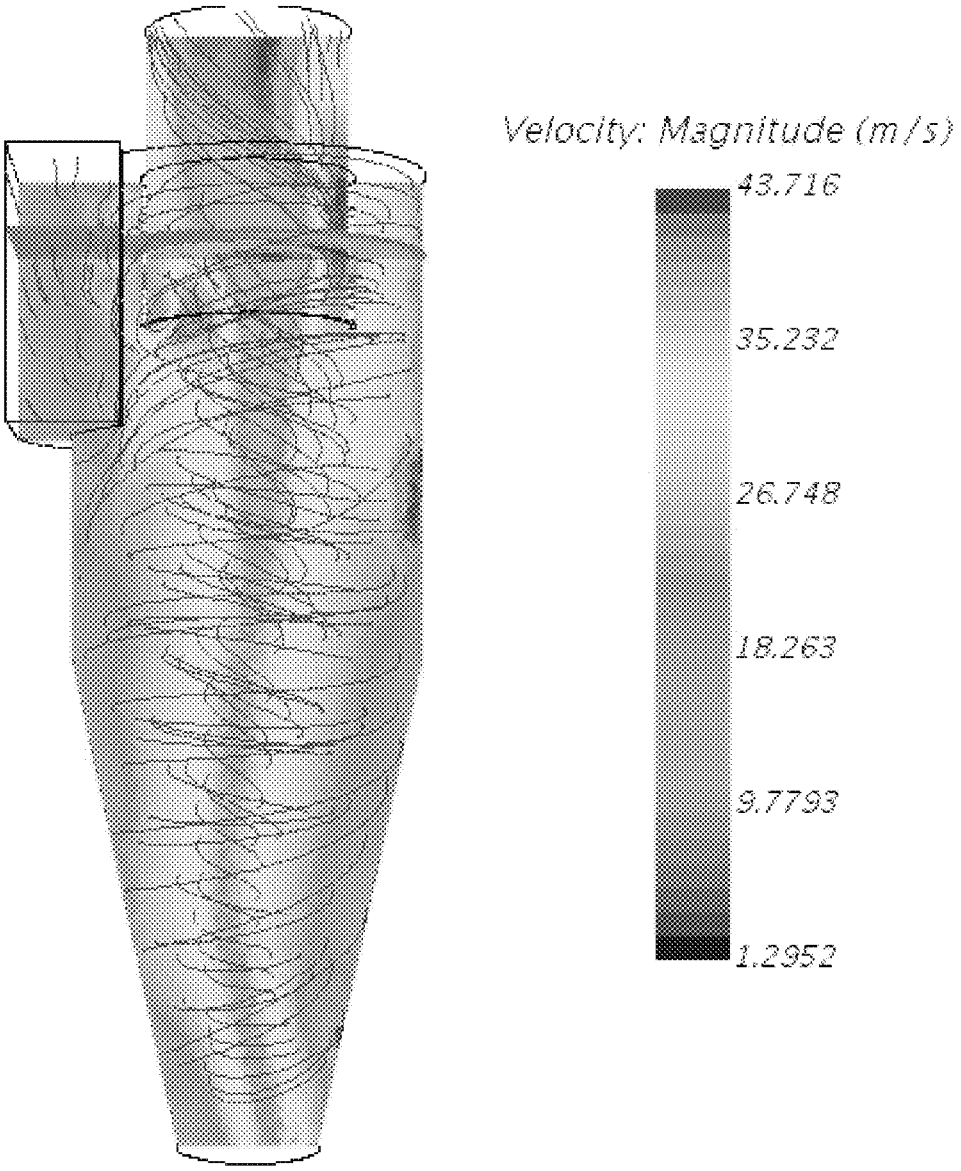
FIG. 2 PRIOR ART
FIG. 2 is a CFD simulation of a prior art primary cyclone operating at typical FCCU regenerator conditions showing velocity magnitudes.
Figure 3:
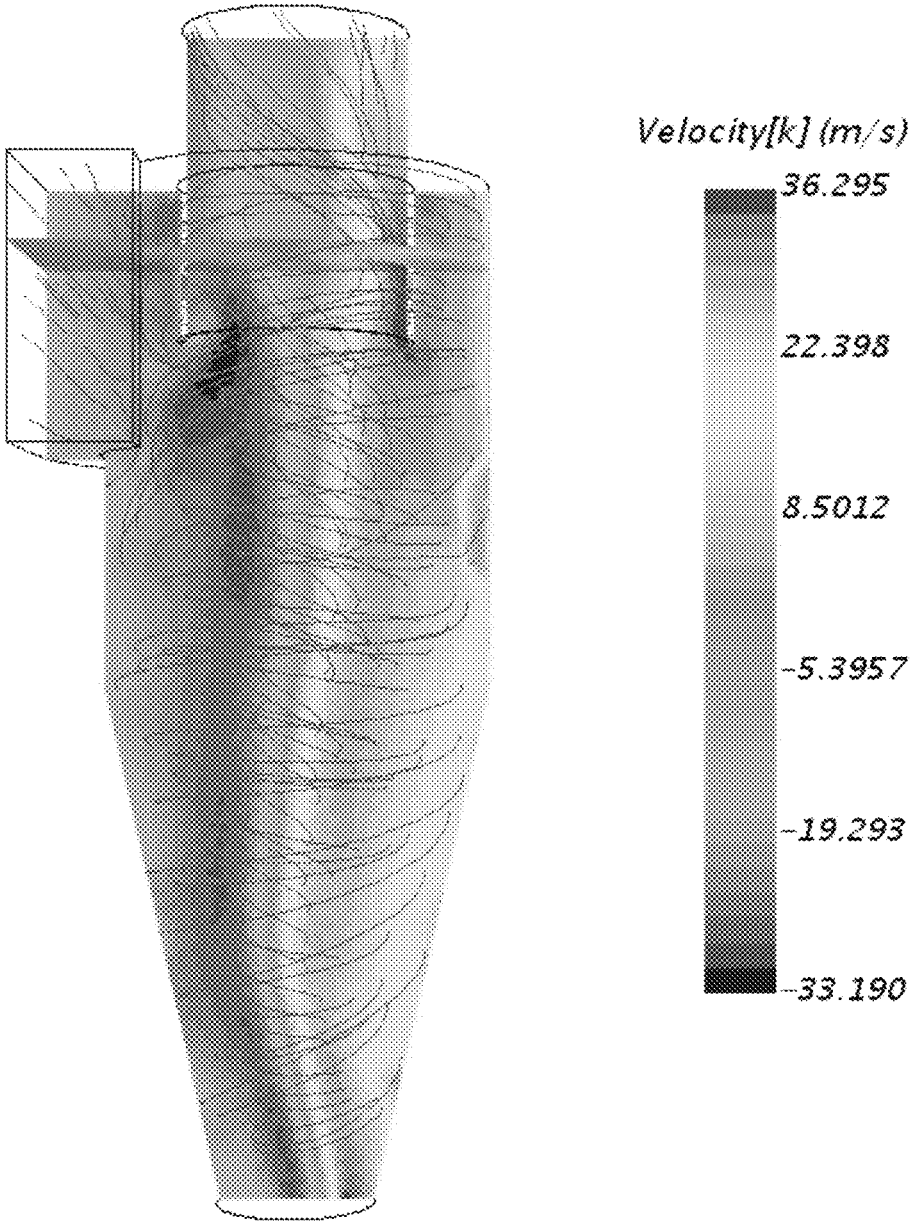
FIG. 3 PRIOR ART
FIG. 3 is a CFD simulation of a prior art primary cyclone operating at typical FCCU regenerator conditions showing velocity profiles.
Figure 4:
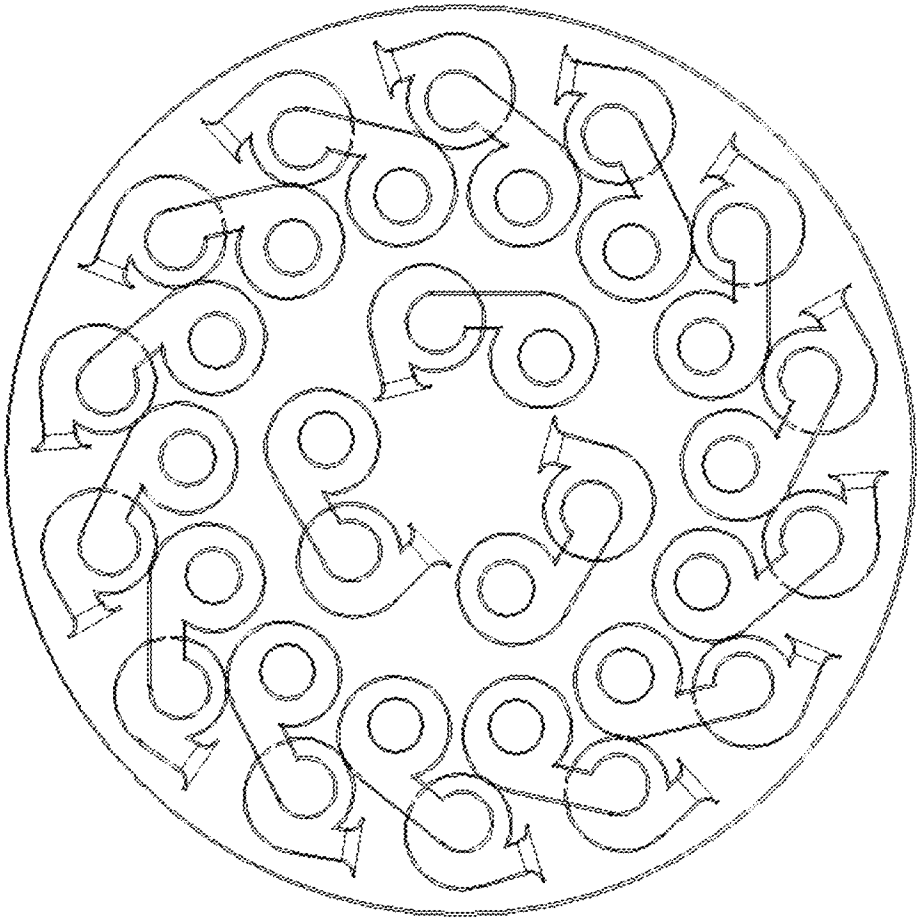
Fig. 4 PRIOR ART
FIG. 4 is a top view schematic of a 42.5 ft (OD) regenerator vessel with 17 sets of 55-inch diameter voluted cyclones of the prior art with six inches of clearance between the vessel ID and each cyclone.
Figure 9:
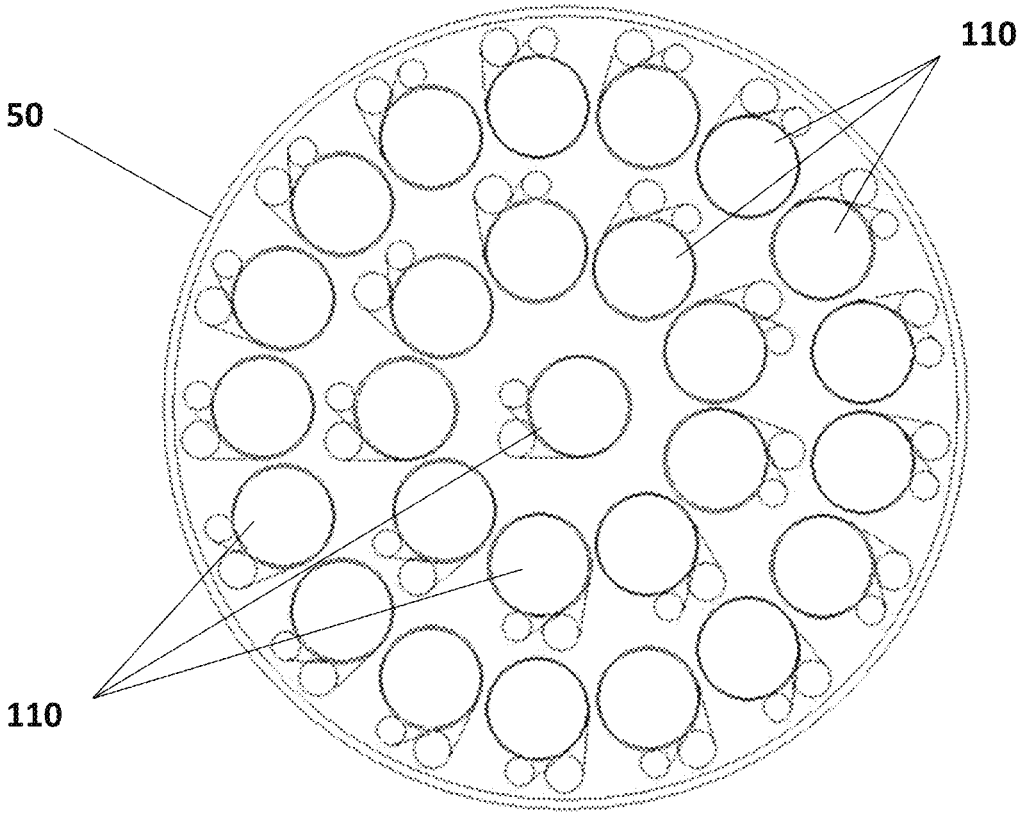
FIG. 9 is a top view schematic of a 42.5 ft (OD) regenerator vessel housing 27 sets of cyclones of the present disclosure.

Fourth, the disclosed cyclone 110 has a smaller footprint than the conventional voluted cyclone pair with the same gas capacity and barrel diameter. FIG. 9 shows a top view of an embodiment of numerous disclosed cyclone 110 laid out in a 42.5 ft diameter vessel 50. It shows 27 cyclone sets in the vessel. Compare this to FIG. 4 which shows the same 42.5 ft diameter vessel 50 with only 17 conventional cyclone pairs.

While the disclosed cyclone 10, 110 can be used to increase the gas handling capacity of the vessel 50 beyond what is possible with conventional cyclones, it may not be practical to go that far. The superficial gas velocity will go up by the ratio of the number of cyclones, and that has a dramatic effect on the disengaging height. However, this capability to put more cyclones in the regenerator coupled with the higher efficiency of the cyclones could be used to reduce cyclone inlet velocity and prolong cyclone life.

Figure 10:
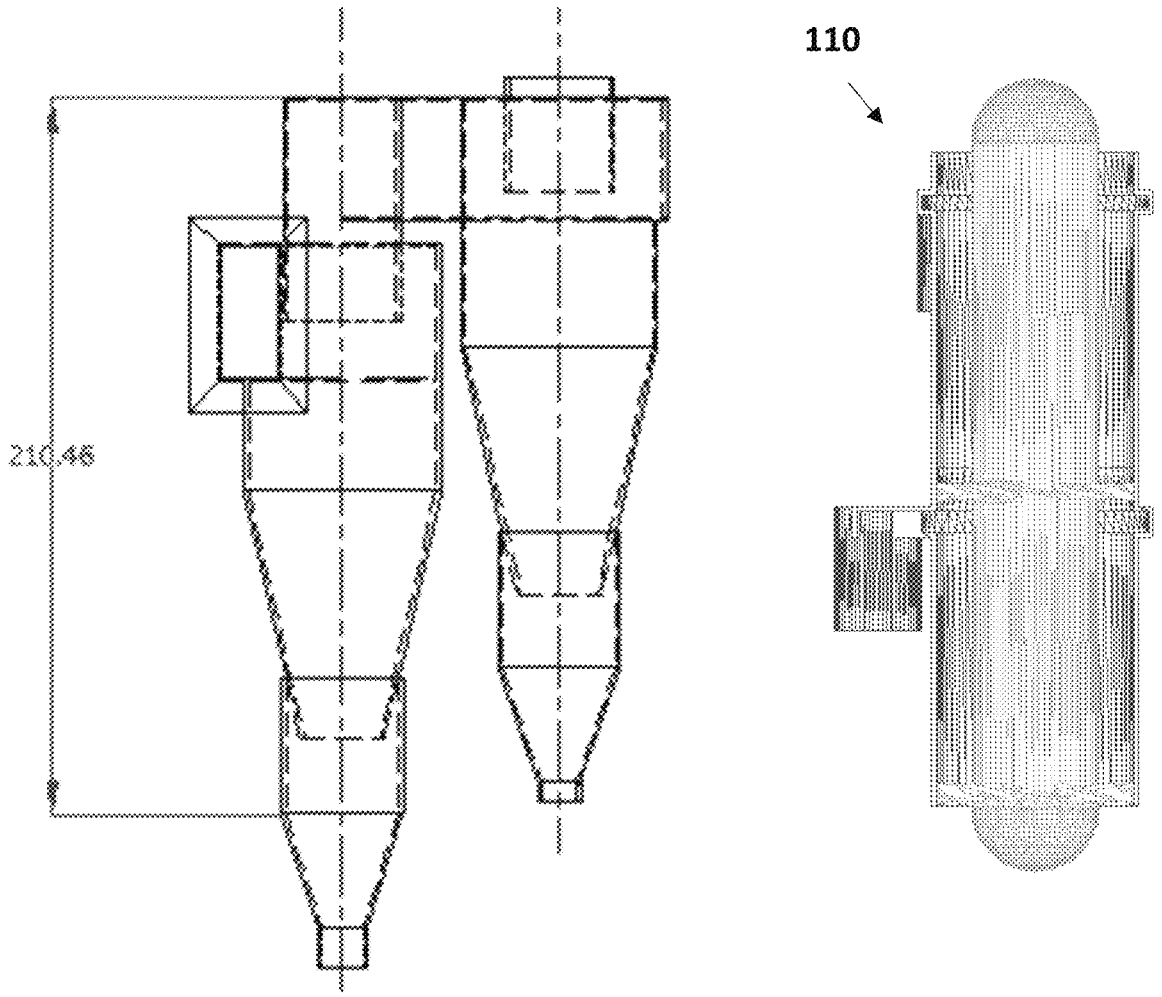
FIG. 10 is a side schematic showing a height comparison between a classic two-stage cyclone set (left) and a two-stage cyclone set of the present invention.

Fifth, the stacked pair of cyclones 110 has similar elevation requirements as conventional cyclones with the same gas capacity. FIG. 10 shows a comparison of a classic cyclone and an embodiment of the disclosed cyclone 110. Both have the same barrel diameter and gas capacity. The center pipe 126 of the disclosed cyclone 110 is the same diameter as a primary cyclone outlet tube, so they both have the same peak gas velocity. Both would be mounted under a plenum chamber at the top of the containment vessel 50. The center pipe 126 of the disclosed cyclone 110 can extend into the plenum chamber.

The barrel 112 above the second particle collection channel 118 would be welded to the plenum chamber. The classic cyclone second stage outlet tube is also typically welded to the plenum chamber. The overall height of the two devices is very similar, approximately 210.5 inches for the classic cyclone and approximately 181 inches for a preferred embodiment of the disclosed cyclone. If credit is taken for the superior vortex length of cyclone 110, this design could be shortened by approximately 36 inches to give equivalent primary vortex lengths.

Containment vessel tangent length is determined by one of two factors; either the necessary dip leg length to overcome cyclone pressure drop or the disengaging height. The "disengaging height" is the elevation at which the particle entrainment rate has stabilized. The disclosed cyclone 110 would seem to have a shorter disengaging height than the classic cyclone shown in FIG. 10. That is, the disclosed cyclone 110 has an inlet 40 at the bottom of the cyclone, whereas the classic cyclone has an inlet somewhat higher. However, while the disengaging height assumes a constant velocity, significant acceleration occurs when the rising gases encounter the bottom of a cyclone. This makes it more difficult to disengage additional amounts of particulate matter above the bottom of the primary dust hopper.

Additionally, the stacked cyclone described herein would have longer dip leg clearances, which would reduce tangent length in cases where the dip leg length is controlling.

Figure 11A:
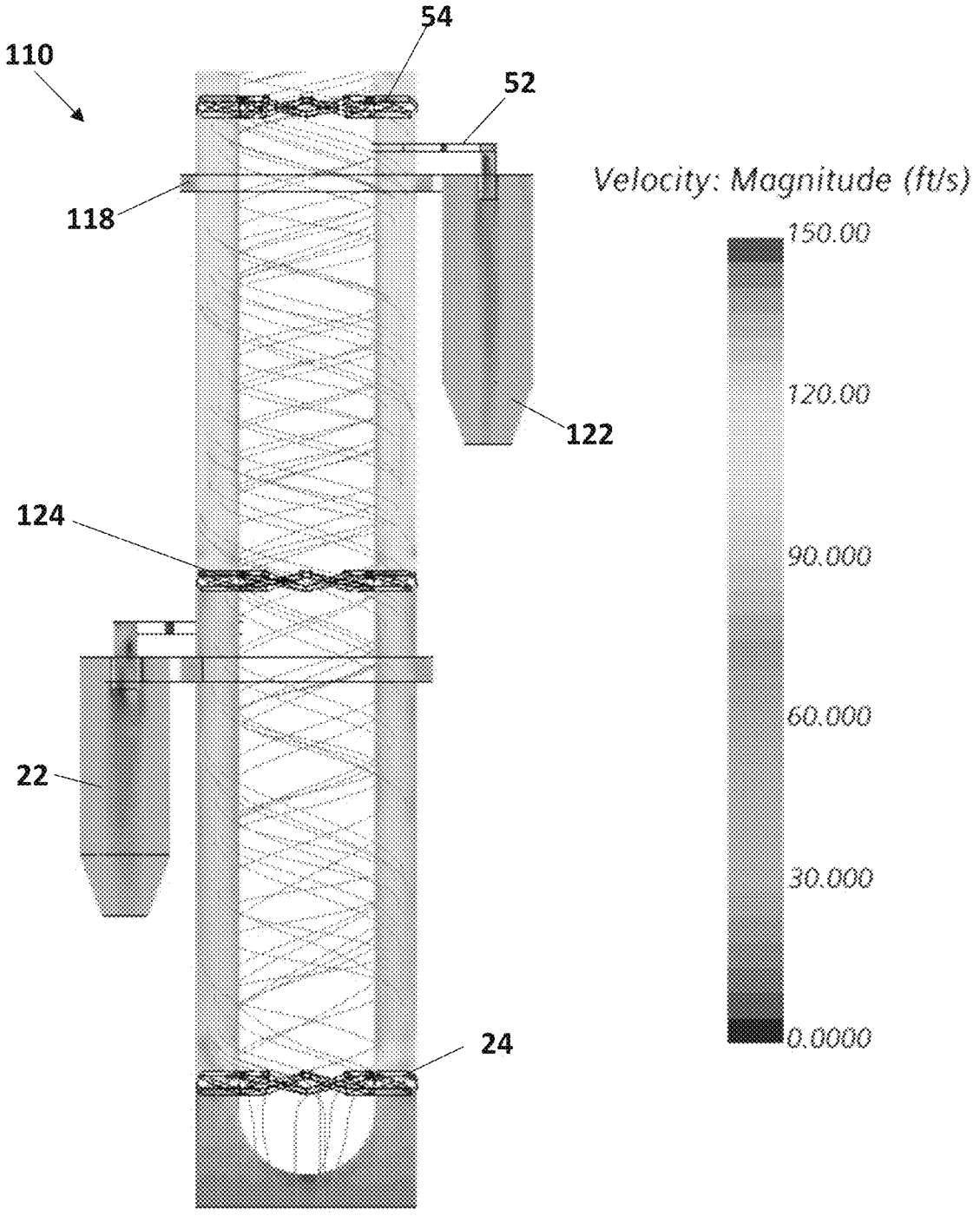
FIG. 11A is a CFD simulation showing velocity magnitude and stream for an embodiment of a two-stage stacked separator of the present invention.
Figure 11B:
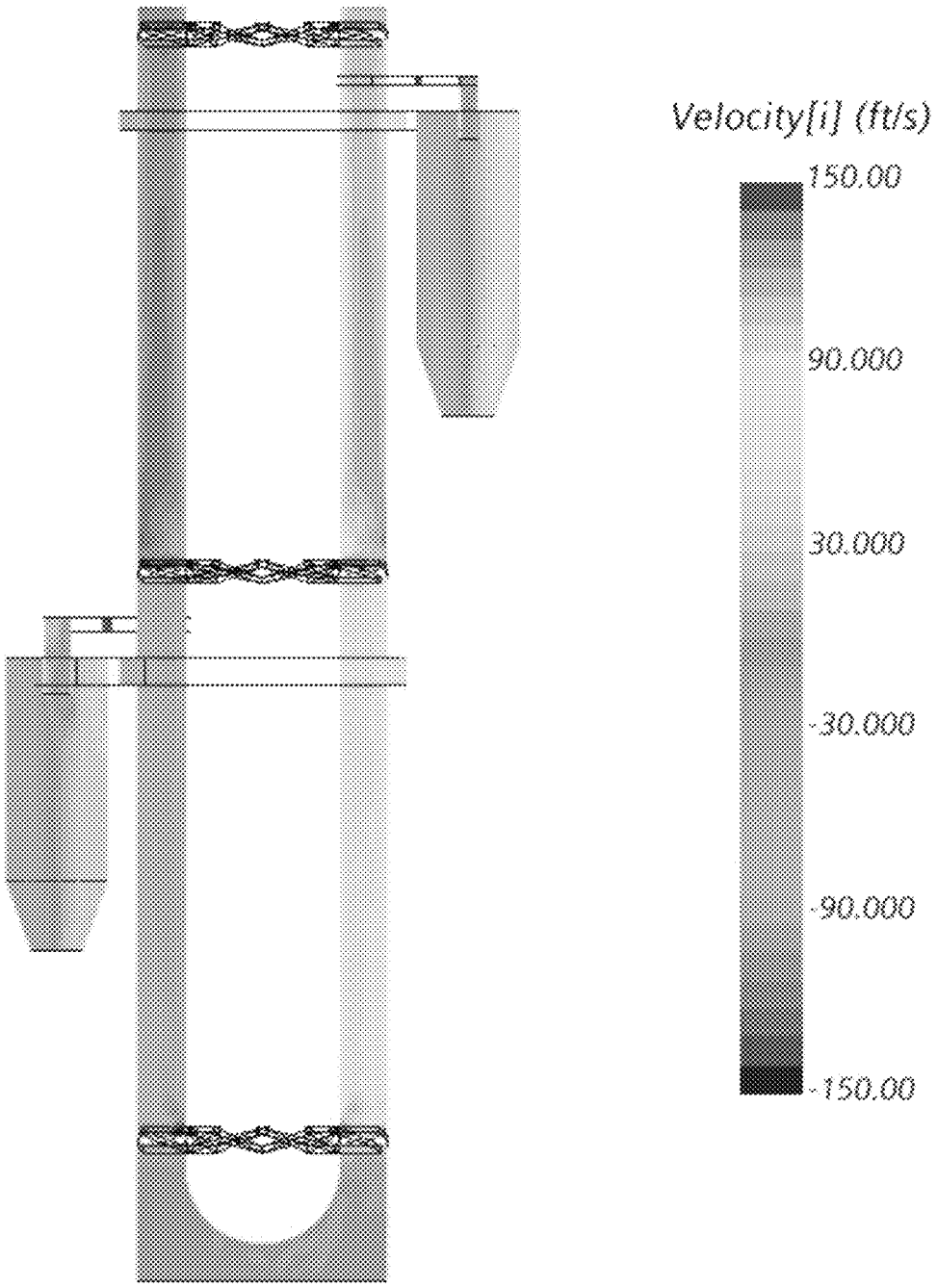
FIG. 11B is a CFD simulation showing out-of-page velocity component lines for an embodiment of a two-stage stacked separator of the present invention.

FIG. 11 shows CFD analysis of tangential gas flow in a two-stage design with higher velocity in the second stage. This simulation shows a gas vent 52 from each of the dust hoppers and the analysis shows that the vent is not needed. It also shows an outlet vane 54 which is included to add stability to the center pipe 126. Especially notable in the simulation is the uniformity of the vortex streamlines and velocity profiles.

Figure 12A:
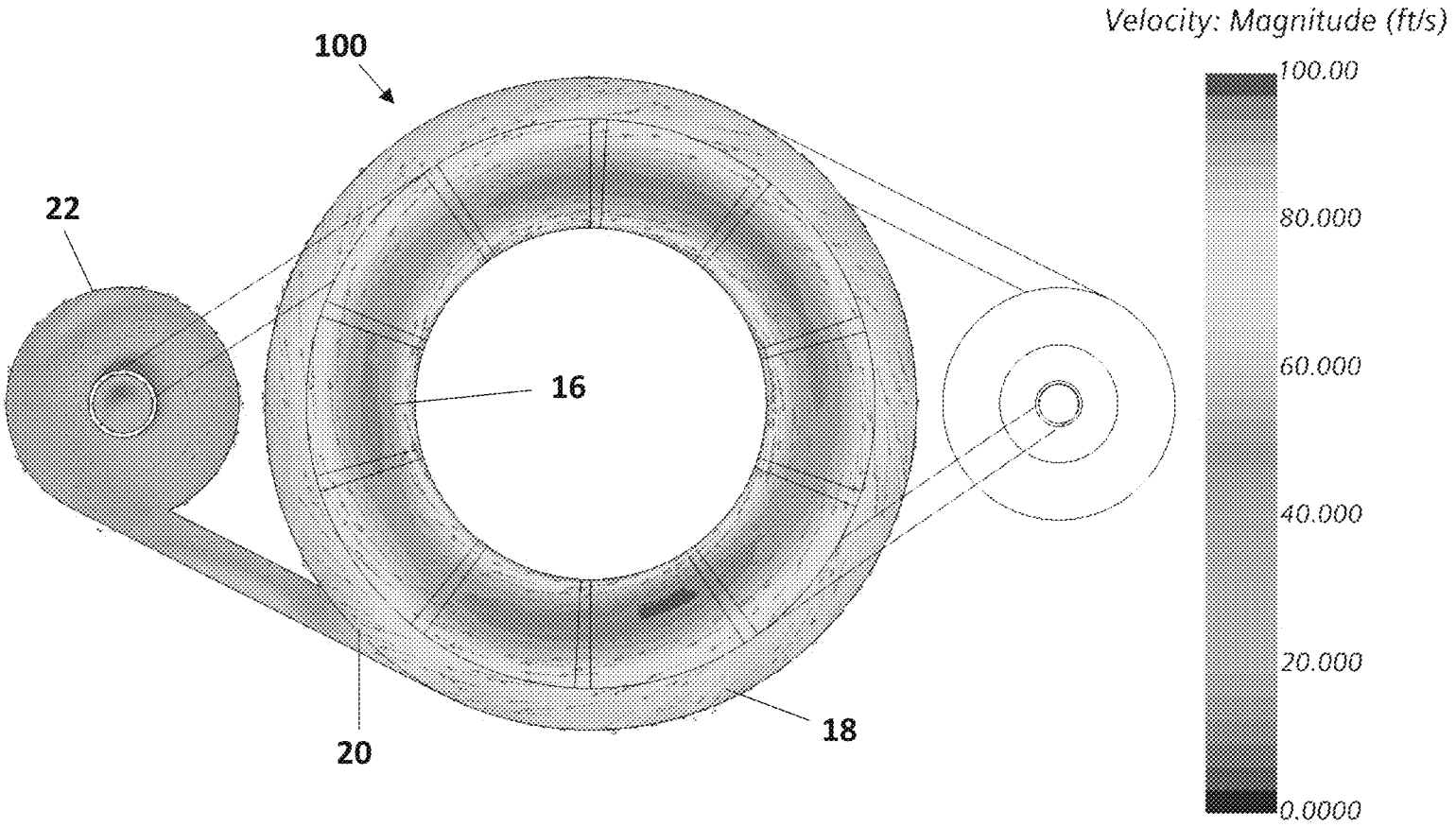
FIG. 12A is a CFD simulation of a vertical cross-section at the first separation channel of an embodiment of a two-stage stacked separator of the present invention showing gas flow at the primary (i.e., first) stage.
Figure 12B:
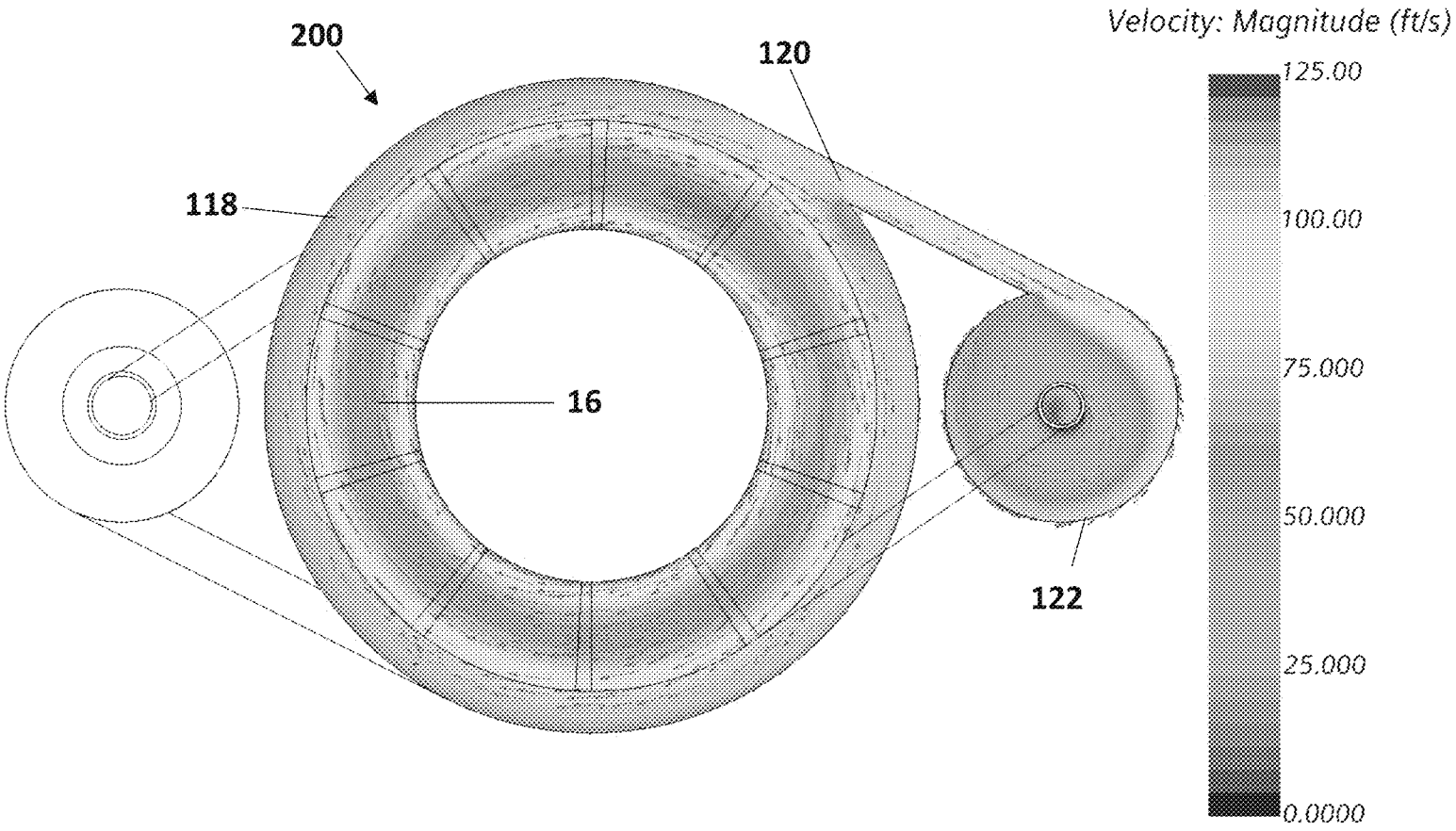
FIG. 12B is a CFD simulation of a vertical cross-section at the first separation channel of an embodiment of a two-stage stacked separator of the present invention showing gas flow at the secondary (i.e., upper) stage.

In FIGS. 12A and 12B, the gas flow patterns in the cyclone, the solids separation channel, the solids extraction ports 20, 120, and the dust hoppers 22, 122 are shown. It is notable that the gas flow is very stable in the barrel area or collection zone 14 and the solids ejection ports 20, 120 have little effect on the gas flow patterns.

Figure 13A:
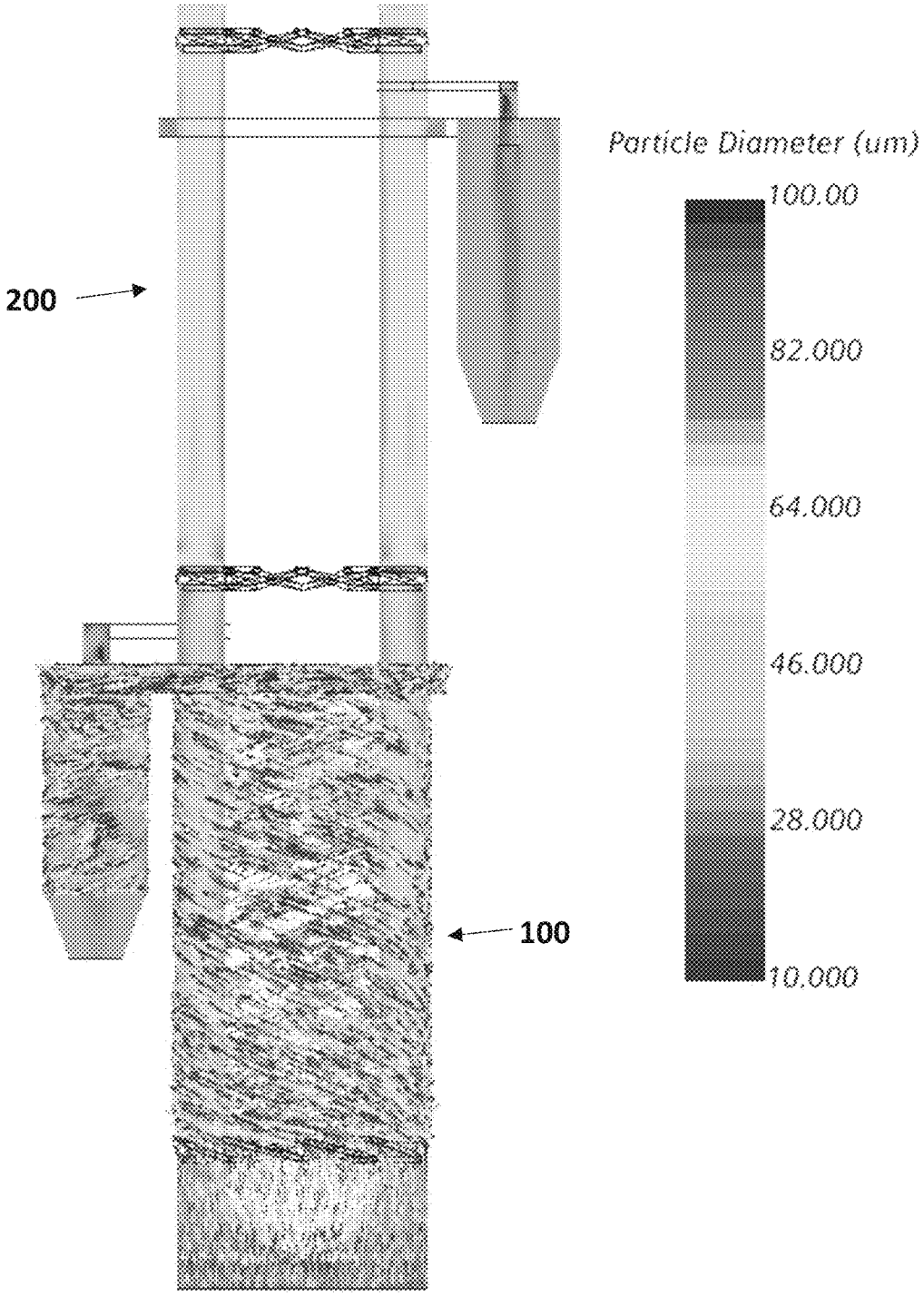
FIG. 13A is CFD simulation of a two-stage stacked separator of the present invention showing predicted performance for removal of particles in the 10 to 100 micron diameter range at typical FCCU regenerator conditions.
Figure 13B:
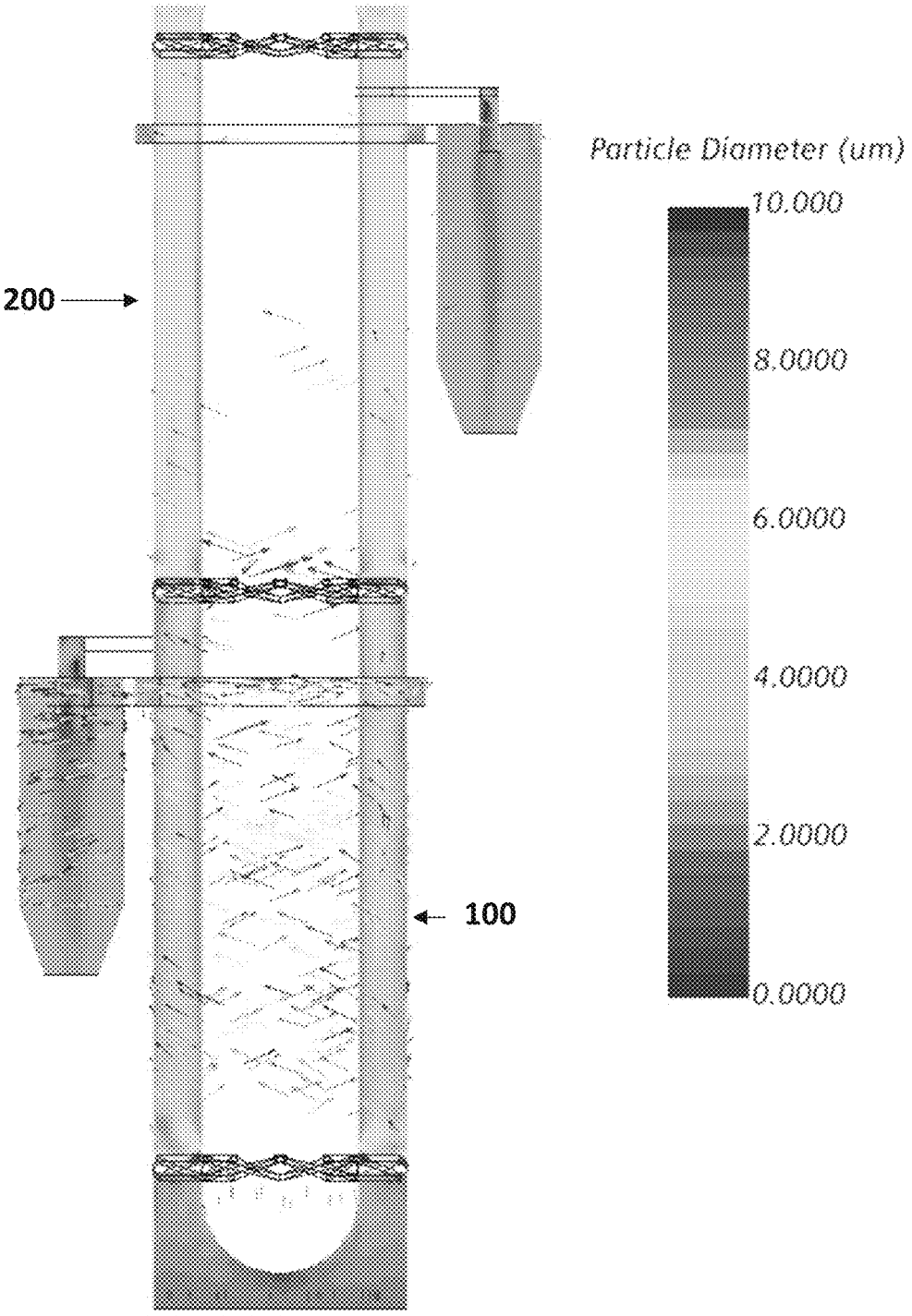
FIG. 13B is CFD simulation of a two-stage stacked separator of the present invention showing predicted performance for removal of particles in the >0 to 10 micron diameter range at typical FCCU regenerator conditions.

FIGS. 13A and 13B show CFD model predictions for the removal of particles consistent with FCC catalyst at conditions similar to operating conditions typical of an FCC regenerator. The CFD modeling shows relative concentrations of particles and their typical flow paths in the cyclones. Since the concentration of the finer particles is small compared to overall quantities, the representations shown are more qualitative than quantitative. Therefore, it is very difficult to predict the collection efficiency for any particular size.

Figure 14:
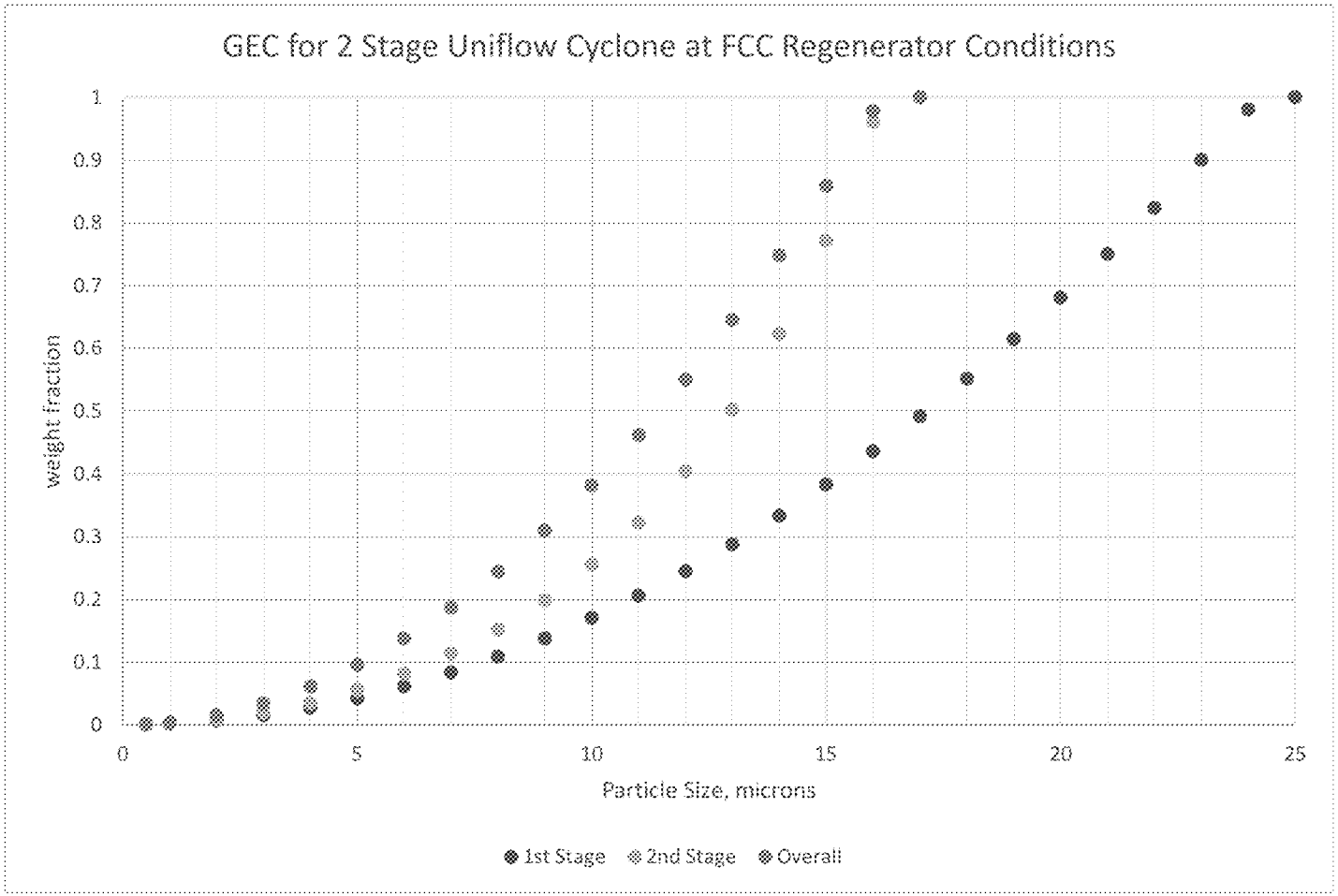
FIG. 14 is line graph showing grade efficiency curve predictions for a two-stage stacked separator of the present invention at typical FCCU regenerator conditions.

FIG. 14 shows the predicted theoretical performance of an embodiment of a two-stage cyclone pair 110 from the theory developed earlier. As noted earlier, the theory derived from Stoke's Law does not take into consideration the interaction between larger particles and smaller particles in the centrifugal field. It represents the best efficiency one might expect from a perfect cyclone with very low dust loadings. As the dust loading is increased the efficiency curves, especially for the first stage, would be expected to shift to the left. The bulk of the particles feeding an FCCU cyclone would be much larger, with an average size of approximately 60 microns. The prediction says the first stage removes 100% of the particles greater than 24 microns and the second stage removes nearly 100% of the 16 micron and larger particles.

$3^{rd}$ Stage Separator

The disclosed cyclone 10 can be used on third-stage separators, as well. The third-stage separator (TSS) is located downstream of a FCCU regenerator and was originally developed to remove any 10 micron and larger particles from a flue gas upstream of power recovery turbines. The ten microns plus (10+) particles cause considerable wear on turbine blades. More recently, the efficiency of the TSS has improved such that they are sometimes employed as air pollution devices and can be designed to remove four-plus (4+) micron particles and even smaller. As air pollution regulations become more restrictive, use of a TSS becomes less viable as final flue gas clean-up devices.

These devices are somewhat smaller than those used in the regenerator with barrels sized in the 10 to 12 inch diameter range. Cyclones used in regenerators are normally sized between 50 and 60 inches in diameter. Because the particle loading to the TSS is much lower than in the regenerator (approx. 400 $mg/Nm^3$ vs. approx. 0.7 $lbs/ft^3$), they can be operated at much higher velocities, generally around 250 ft/sec.

Figure 5:
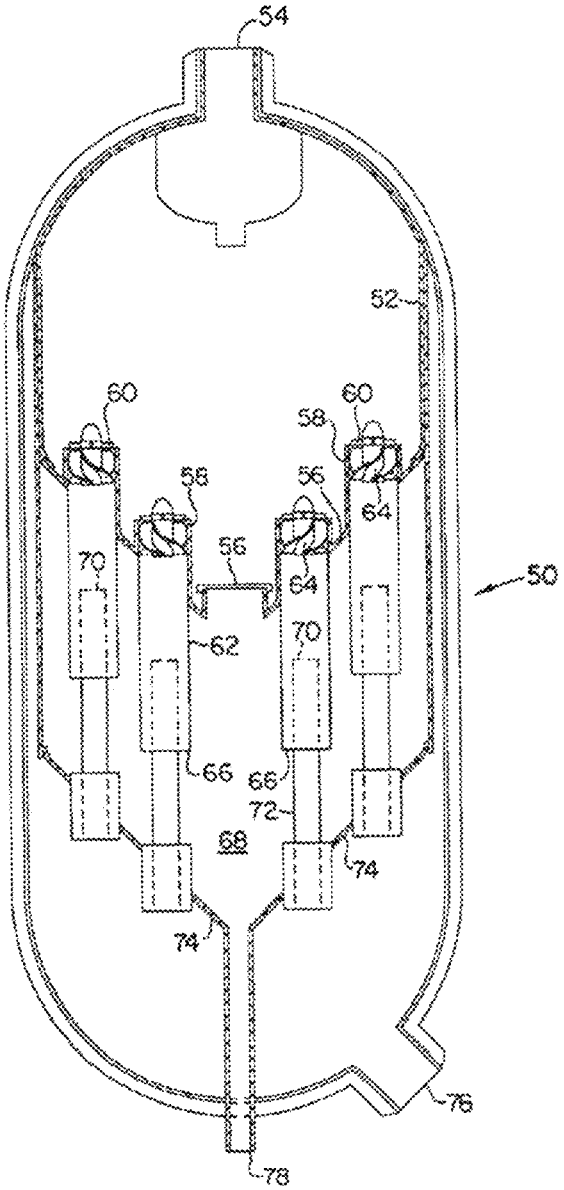
FIG. 5 is a schematic of a Third Stage Separator from U.S. Pat. No. 6,673,133 showing individual uniflow cyclones mounted in the separator vessel.
Figure 15A:
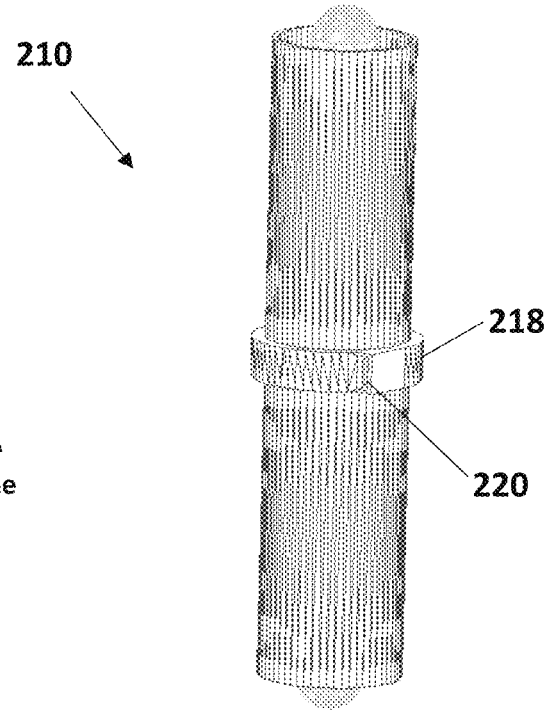
FIG. 15A is a side view of an embodiment of a third-stage separator (TSS) in accordance with the present disclosure.
Figure 15B:
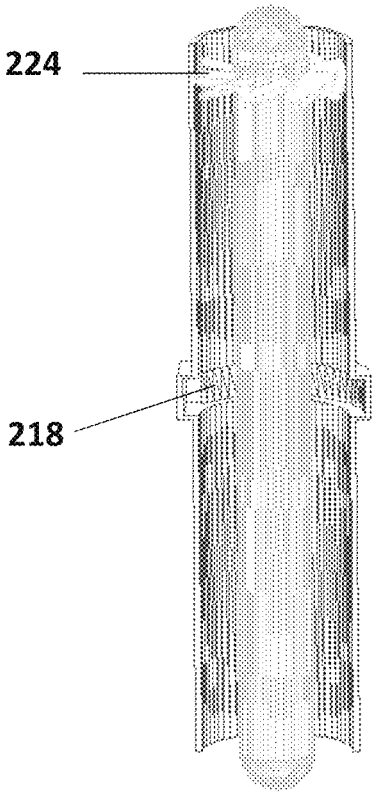
FIG. 15B is a cut-away view of the TSS of FIG. 15A.
Figure 15C:
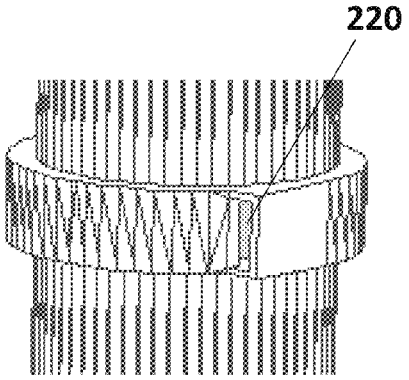
FIG. 15C is an enlarged close-up view of the peripheral channel exterior showing the solids ejection port.

FIGS. 15A-15C show an embodiment of the disclosed cyclone 210 designed for TSS applications. This cyclone 210 would be substituted for the cyclones shown in FIG. 5. The flow is into the top of the cyclone 210 which is above the top tube sheet. The gas encounters the vane 224, and the vortex is formed. The particles migrate toward the wall 216 by centrifugal forces generated by the vortex and eventually into the enlarged section of the barrel 212 where they accumulate in the channel 218 until they are discharged from the port 220 shown in FIG. 15A. This channel 218 and solids ejection port 220 are located between the two tube sheets shown in FIG. 5 and flow out the bottom of the of that zone. The gas continues in a vortex to the bottom end of the cyclone 210 which discharges below the bottom tube sheet of FIG. 5. While a rather simple vane is shown here, the vane shown in FIG. 5 could also be used, or any other vane that produces desired vortex properties.

An embodiment of the overall cyclone 210 is shown in FIG. 15A. Half of the barrel 212 has been removed in FIG. 15B to show the vane 224 and its relation to the solids collection channel 218 and the solids ejection port 220. FIG. 15C is a close up of the solids collection channel 218 from FIG. 15A including the solids ejection port 220. In some cases, the port will be extended even farther to ensure tangential flow from the cyclone channel.

Figure 16:
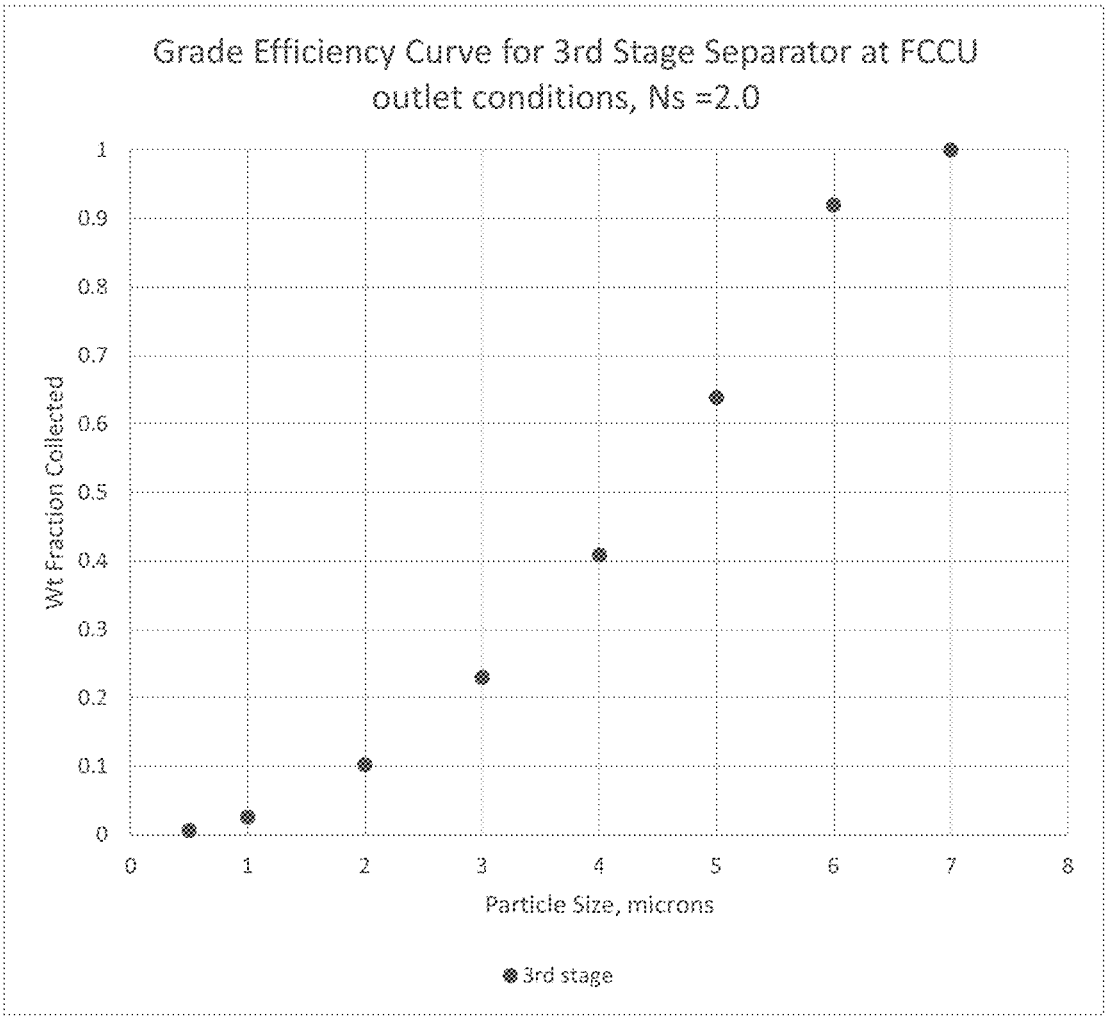
FIG. 16 is line graph showing grade efficiency curve prediction for an embodiment of a TSS of the present invention at typical FCCU regenerator operating conditions.

FIG. 16 shows the expected performance of the invention when it is operated at conditions consistent with FCCU Regenerator flue gas conditions. The design would be for a 10-inch barrel and two revolutions of the vortex. The designer can vary the performance by manipulating Equation 3 above. However, the higher the velocity, the greater the catalyst attrition, the greater the number vortex revolutions, the greater the catalyst attrition, and finally the narrower the gap ($w_c$), the lower the cyclone capacity.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A uniflow cyclone separator for removing solids from a vortex, the cyclone separator comprising:

a first stage separator comprising:

a barrel having first and second ends and comprised of a cylindrical wall having a predetermined height;

a center pipe positioned within the barrel and extending for at least the entire height of the cylindrical wall;

a gas inlet for injecting a fluid into the barrel proximate the first end;

a vane attached to the center pipe proximate the gas inlet for initiating a vortex from the injected fluid;

a peripheral channel positioned within the cylindrical wall proximate the second end of the barrel; and a tangential solids ejection port connecting the peripheral channel to a dust hopper;

wherein, the vortex remains relatively undisturbed and continues through the barrel past the peripheral channel; and entrained solids within the vortex are removed by entering the dust hopper via the peripheral channel;

a second stage separator stacked onto the first stage separator, the second stage separator comprising:

an extension of the cylindrical wall from the second end to an extended end;

an extension of the center pipe to extend the center pipe for at least the entire height of the cylindrical wall and the extension of the cylindrical wall;

a second vane attached to the extension of the center pipe above the peripheral channel, the second vane being for maintaining the vortex of the injected fluid;

a second peripheral channel positioned within the extension of the cylindrical wall proximate the second end of the barrel; and a second tangential solids ejection port connecting the second peripheral channel to a second dust hopper;

wherein, the initiated and maintained vortex remains relatively undisturbed and continues through the barrel past the second peripheral channel; and entrained solids within the vortex are removed by entering the second dust hopper via the second peripheral channel.

2. The uniflow cyclone separator of claim 1, wherein the vortex is modified by the second vane with a pitch which will change the velocity in the vortex by changing the vortex angle.

3. A uniflow cyclone separator for removing solids from a vortex, the cyclone separator comprising:

a first stage separator comprising:

a barrel having first and second ends and comprised of a cylindrical wall having a predetermined height;

a center pipe positioned within the barrel and extending for at least the entire height of the cylindrical wall;

a gas inlet for injecting a fluid into the barrel proximate the first end;

a vane attached to the center pipe proximate the gas inlet for initiating a vortex from the injected fluid;

a peripheral channel positioned within the cylindrical wall proximate the second end of the barrel; and a tangential solids ejection port connected to the peripheral channel to eject entrained solids from the vortex;

wherein the vortex remains relatively undisturbed and continues through the barrel past the peripheral channel;

a second stage separator stacked onto the first stage separator, wherein the second stage separator comprises:

an extension of the cylindrical wall from the second end to an extended end;

an extension of the center pipe to extend the center pipe for at least the entire height of the cylindrical wall and the extension of the cylindrical wall;

a second vane attached to the extension of the center pipe above the peripheral channel, the second vane being for maintaining the vortex of the injected fluid;

a second peripheral channel positioned within the extension of the cylindrical wall proximate the second end of the barrel; and a second tangential solids ejection port connected to the second peripheral channel to eject entrained solids from the vortex;

wherein the initiated and maintained vortex remains relatively undisturbed and continues through the barrel past the second peripheral channel.

4. The uniflow cyclone separator of claim 3, wherein the vortex is modified by the second vane with a pitch which will change the velocity in the vortex by changing the vortex angle.

5. A uniflow cyclone separator for removing solids from a vortex, the cyclone separator comprising:

a first stage separator comprising:

a barrel having first and second ends and comprised of a cylindrical wall having a predetermined height;

a center pipe positioned within the barrel and extending for at least the entire height of the cylindrical wall;

a gas inlet for injecting a fluid into the barrel proximate the first end;

a vane attached to the center pipe proximate the gas inlet for initiating a vortex from the injected fluid;

a peripheral channel positioned within the cylindrical wall proximate the second end of the barrel; and a tangential solids ejection port connecting the peripheral channel to a dust hopper;

wherein, the vortex remains relatively undisturbed and continues through the barrel past the peripheral channel; and entrained solids within the vortex are removed by entering the dust hopper via the peripheral channel;

a plurality of cyclone separator stages stacked consecutively onto the first stage separator, wherein each of the plurality of cyclone separator stages comprises:

an extension of the cylindrical wall from a previous stage wall to an extended end;

an extension of the center pipe to extend the center pipe for at least the entire height of the cylindrical wall and the extension of the cylindrical wall;

a tertiary vane attached to the extension of the center pipe for maintaining the vortex of the injected fluid;

a tertiary peripheral channel positioned within the extension of the cylindrical wall; and a tertiary tangential solids ejection port connected to the tertiary peripheral channel;

wherein, the initiated and maintained vortex remains relatively undisturbed and continues through the barrel past each tertiary peripheral channel; and entrained solids within the vortex are removed by entering the tertiary peripheral channel.

6. A uniflow cyclone separator of claim 5, wherein the tertiary vane is located and angled to increase a tangential velocity of the vortex in consecutive stages.

7. A uniflow cyclone separator of claim 5, further comprising a tertiary dust hopper connected to the tertiary peripheral channel of at least one of the plurality of stages.

8. A uniflow cyclone separator of claim 5, further comprising an open area between two tube sheets positioned between consecutive stages of the plurality of stages, wherein entrained solids are ejected from the tertiary solids ejection port into the open area.

* * * * *